United States Patent [19]

Klowak

[11] Patent Number: 4,849,054

[45] Date of Patent: Jul. 18, 1989

[54] HIGH BULK, EMBOSSED FIBER SHEET MATERIAL AND APPARATUS AND METHOD OF MANUFACTURING THE SAME

[75] Inventor: Bernard G. Klowak, Neenah, Wis.

[73] Assignee: James River-Norwalk, Inc., Norwalk, Conn.

[21] Appl. No.: 144,724

[22] Filed: Jan. 14, 1988

Related U.S. Application Data

[63] Continuation of Ser. No. 804,569, Dec. 4, 1985, abandoned.

[51] Int. Cl.[4] ..... D21H 5/02

[52] U.S. Cl. ..... 162/109; 162/111; 162/113; 162/117; 162/204; 162/280; 162/281; 162/289; 162/306; 162/361; 162/362; 162/363

[58] Field of Search ..... 162/109, 111, 113, 112, 162/117, 280, 281, 361, 362, 363, 364, 306, 289, 204, 287

[56] References Cited

U.S. PATENT DOCUMENTS 4,551,199 11/1985 Weldon ..... 162/111

*Primary Examiner*—Peter Chin

*Attorney, Agent, or Firm*—Finnegan, Henderson, Farabow, Garrett & Dunner

[57] ABSTRACT

A bulky, embossed, fibrous web material having a basis weight in the range of 5 to 50 lbs./ream and geometric means tensile strength (TS) (kg/3' width), apparent bulk (AB) (cal. pts./lb. ream), and oil holding capacity (OH) (ml/gm fiber) substantially satisfying, in absolute values, the relationships $(0.27\ BW-1)\ TS>(0.17\ BW-1)$, $AB>[0.7-(TS\div 20)]$, and $OH\ 0.063TS^2-1.13TS+8.6$. The invention includes an apparatus and a method of manufacturing the product comprising wet pressing a fibrous web to about 30% to 50% solids, conveying the web to a transfer position proximate the three-dimensional surface of an embossing fabric moving at a speed less than that of the web at the transfer position, and applying a vacuum to the web through the embossing fabric to transfer and conform the web to the three-dimensional surface of the fabric, the vacuum magnitude being in the range of 1 to 20 inches Hg.

14 Claims, 18 Drawing Sheets

APPARENT BULK
VS.
BASIS WEIGHT
APPARENT BULK, .001"/lb REAM
1.0
.9
.8
.7
.6
.5
.4
.3
.2
.1
10
20
30
BASIS WEIGHT
ΔS=25%
ΔS=20%
ΔS=10%
ΔS=0
CONVENTIONAL
CREPED 20%
CONVENTIONAL
UNCREPED

DRY TENSILE STENGTH
VS.
BASIS WEIGHT

APPARENT BULK
VS.
TENSILE DRY STRENGTH

AIR PERMEABILITY
VS.
BASIS WEIGHT
AIR PERMEABILITY, fpm @ .5" H2O ΔP
200
150
100
90
80
70
60
50
40
30
20
10
0
10
12
14
16
18
20
22
24
26
28
30
BASIS WEIGHT
ΔS=25%
ΔS=20%
CONVENTIONAL
CREPED 20%
ΔS=10%
ΔS=0%
CONVENTIONAL
UNCREPED OIL HOLDING CAPACITY
VS.
BASIS WEIGHT
CONVENTIONAL
CREPED 20%
ΔS=25%
ΔS=20%
ΔS=10%
ΔS=10%
CONVENTIONAL
UNCREPED
OIL HOLDING CAPACITY (ml/g)
12.0
11.0
10.0
9.0
8.0
7.0
6.0
5.0
4.0
3.0
2.0
1.0
5
10
15
20
25
30
BASIS WEIGHT (lb/REAM)

OIL HOLDING CAPACITY
VS.
TENSILE DRY STRENGTH
INVENTION
20%
CREPE
UNCREPED
OIL HOLDING CAPACITY, g/ml
12
10
8
6
4
2
2000
4000
6000
8000
10000
TENSILE STRENGTH (gm), g/3"

MD NOLL SOFTNESS
VS.
BASIS WEIGHT
ΔS=0
CONVENTIONAL
UNCREPED
ΔS=10%
ΔS=20%
ΔS=25%
CONVENTIONAL
CREPED
MD NOLL SOFTNESS, g
BASIS WEIGHT
0
1
2
3
4
5
6
7
8
10
20
30

CD NOLL SOFTNESS
VS.
BASIS WEIGHT
ΔS=10%
ΔS=20%
ΔS=25%
ΔS=0
CONVENTIONAL
UNCREPED
CONVENTIONAL
CREPED, 20%
CD NOLL SOFTNESS, g
BASIS WEIGHT
0
10
20
30
10
20
30

TOTAL ENERGY ABSORPTION
MD TEA
VS.
BASIS WEIGHT
CONVENTIONAL UNCREPED
ΔS=0
ΔS=10%
ΔS=20%
ΔS=25%
CONVENTIONAL CREPED, 20%
MD TEA, in-g
BASIS WEIGHT
0
20
40
60
80
100
120
140
160
180
5
10
15
20
25
30
35

HIGH BULK, EMBOSSED FIBER SHEET MATERIAL AND APPARATUS AND METHOD OF MANUFACTURING THE SAME

This application is a continuation of application Ser. No. 06/804,569, filed Dec. 4, 1985, now abandoned.

BACKGROUND OF THE INVENTION

1. Field of the Invention

This invention relates to fibrous sheet material having improved bulk and strength characteristics and a method and apparatus for manufacturing it.

2. Description of Related Art

Many products made of fibrous sheet material, such as paper, require softness, absorbancy and strength. A principal characteristic of such material, contributing to absorbancy and subjective softness, is the bulk or compressability of the material. Conventional manufacturing techniques produce high bulk paper products by avoiding significant compression of the wet fibrous web during the manufacturing process and by creping or embossing the fibrous web and/or adding chemical debonders. These known processes achieve desired bulk by minimizing inter-fiber bonding. Minimizing compression of the web reduces interfiber contact and, therefore, reduces bonding. Creping achieves this result by breaking a substantial fraction of the fiber bonds. Embossing achieves the result by mechanically pressing the web onto a open-mesh imprinting fabric, or other patterned surface, such that a substantial portion of the web area is impressed into voids and the web is subjected to significant compaction only at the non-void areas thus confining the fiber bonding to the non-void areas. Chemical debonders, which may be used with any of the other known techniques, further reduce interfiber bonding.

The strength of the paper is achieved through fiber bonding. Known high-bulk fibrous material, therefore, generally has low strength. In known processes, the strength of the paper product must be sacrificed in order to achieve the high-bulk desired for softness and absorbancy.

Additionally, the known processes which avoid compression of the wet web before embossing are energy intensive. It generally requires less energy to remove water from a web through compression than with heat. By avoiding compression, substantially all drying of the web must be performed with heating techniques.

Examples of recent efforts to achieve soft, absorbant fiber sheet material having commercially acceptable strength characteristics are represented by U.S. Pat. Nos. 3,821,068; 4,208,459; 4,309,246; 4,356,059; 4,420,372; 4,421,600; 4,440,597; 4,429,480; 4,551,199 and Re28459. In each of these patents, a method of manufacturing a high-bulk paper products is described which seeks to maximize bulk while minimizing the loss of strength. Each of these known methods is energy intensive and produces a high bulk product of lower strength than provided by this invention.

The present invention improves upon known apparatus and methods of manufacturing high-bulk products resulting in a paper product having significant bulk and substantially improved strength characteristics. In particular, at the same basis weight, the product of the invention compares to conventionally creped and uncreped products as follows:

| Characteristic | Conv. crepe | Conv. uncrepe |
|---|---|---|
| caliper | > | > |
| apparent bulk | > | > |
| tensile strength | > | < |
| air permeability | ≧ | > |
| oil holding capacity | ≧ | > |
| machine direction (MD) softness | > | < |
| cross direction (CD) softness | > | > |
| MD total energy absorb. | > | < |
| CD total energy absorb. | > | < |

SUMMARY OF THE INVENTION

The objects and advantages of the invention may be realized and obtained by means of the instrumentalities and combinations particularly pointed out in the appended claims.

The method of the invention for manufacturing a bulky, embossed fibrous sheet material comprises the steps of forming a wet fibrous web, pressing the web to partially dewater it to between about 30% and about 50% solids, conveying the web to a transfer position proximate the surface of a moving fluidpervious embossing fabric, the web moving at the transfer position in the same direction as and at a speed greater than the fabric, applying a vacuum through the embossing fabric to the web at the transfer position, the magnitude of the vacuum being sufficient to transfer and to generally conform the web to the patterned surface of the fabric, and drying the web.

Preferably, the method includes transferring the partially dewatered web to a rotating roll, forming a non-compression nip between the rotating roll and a loop of embossing fabric rotating at a speed less than the surface speed of the roll, and applying the vacuum through the fabric to the web at the nip to directly transfer and to generally conform the web to the patterned surface of the fabric.

In the preferred embodiment, the difference between the speed of the roll and the speed of the embossing material is about 10% to about 40%.

The apparatus of the invention comprises means for forming a wet fibrous web, compression means for partially dewatering the web, fluid-previous support means having a three-dimensional surface and moving at a predetermined speed for receiving and imparting a three-dimensional pattern to the web, means for conveying the web from the compression means to the support means at a speed greater than the speed of the support means, embossing means for directly transferring the web from the conveying means to the support means for generally conforming the web to the three-dimensional surface of the support means, and means for drying the web after embossing.

Preferably, the compression means comprises a felt loop for receiving the wet web from the forming means and a generally smooth-surfaced roll defining a compression nip with the felt loop.

In the preferred embodiment, the roll comprises the conveying means and defines a non-compression nip with the support means.

It is preferred that the embossing means comprise a vacuum means disposed proximate the non-compression nip defined between the surface of the fluid-pervious material and the smooth-surfaced roll for directing a vacuum through the fluid-pervious material to the web in the non-compression nip.

The product of the invention is a fibrous web product formed by deposition from an aqueous slurry comprising randomly arranged, contacting fibers bonded together in patterned undulations substantially throughout the web, the web having a basis weight (BW) in the range of about 5 to about 50 pounds per ream and having a geometric means tensile strength (TS) in kilograms per three inches width, an apparent bulk (AB) in caliper points per pound ream, and an oil holding capacity (OH) in milliliters per gram of fiber substantially satisfying, in absolute values, the relationships $(0.27\ BW-1)\ TS>0.17\ BW-1)$, $AB>[0.7-(TS\div 20)]$, and $OH>0.063TS^2-1.13TS+8.6$.

The embossed, bulky fibrous web of the invention may have generally constant tensile strength, oil holding capacity and air permeability through a range of basis weights.

More particularly, the product of the invention is a fibrous web product formed by deposition from an aqueous slurry comprising randomly arranged, contacting fibers bonded together in patterned undulations substantially throughout the web, the web having a basis weight in the range of about five to about thirty pounds per ream, a geometric mean tensile strength in the range of about 1,000 to about 7,000 grams per three inches of width, apparent bulk in the range of about 0.4 to about 1.0 caliper points per pound ream, machine direction stretch in the range of about ten percent to about thirty percent, and oil holding capacity in the range of about 4.3 to about 11.0 milliliters of oil per gram of fiber.

BRIEF DESCRIPTION OF THE DRAWINGS

The accompanying drawings which are incorporated in and constitute a part of the specification, illustrate the embodiments of the invention, and together with the description, serve to explain the principles of the invention.

DETAILED DESCRIPTION OF THE PREFERRED EMBODIMENT

Figure 1:
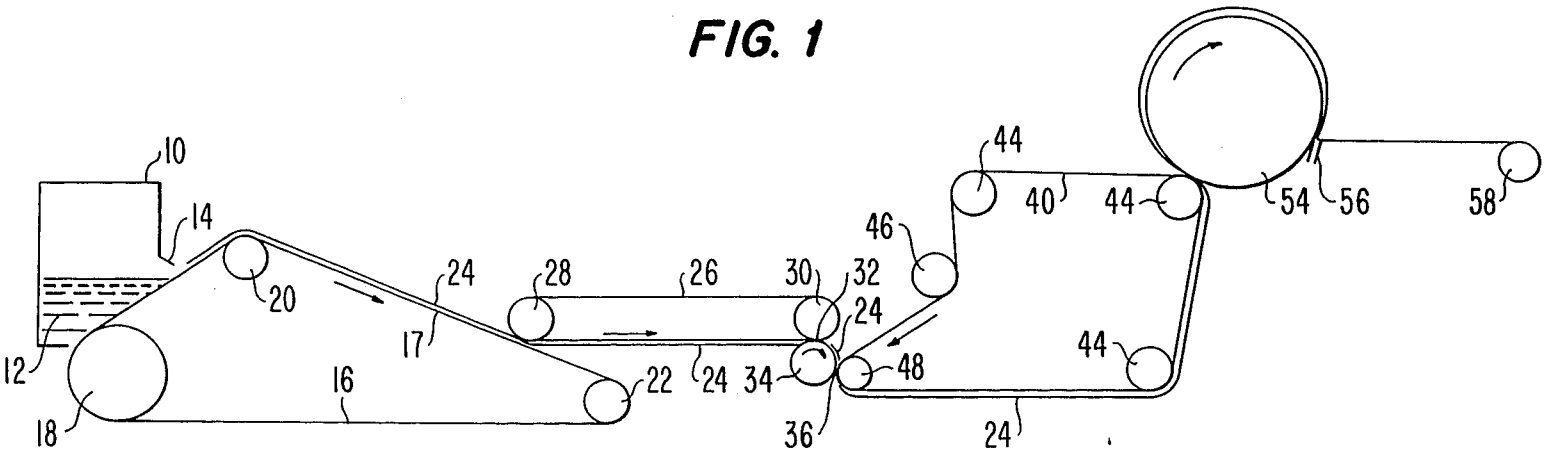
FIG. 1 is a schematic side elevation view of an embodiment of the apparatus of the invention used for forming the fiber sheet material of the invention.

Reference will now be made in detail to the present preferred embodiment of the invention, an example of which is illustrated in the accompanying drawings.

THE APPARATUS

The apparatus of the invention for manufacturing a bulky, embossed fibrous sheet material comprises means for forming a wet fibrous web. As depicted schematically in FIG. 1, the forming means includes a headbox 10 for containing a supply of fiber furnish 12 which generally comprises a dilute slurry of fiber and water. Headbox 10 includes slice 14 disposed over the moving surface of a condenser 16, which in this embodiment is a foraminous woven wire such as a Fourdrinier wire. The fiber furnish in headbox 10 issues from slice 14 onto the upper surface or flight 17 of wire 16. Wire 16 moves in a continuous loop around breast roll 18, wire turning roll 20 and lower couch roll 22. One or more of rolls 18, 20 and 22 are driven to move wire 16 around its loop. Additional guide rolls and table rolls (not shown) may be used to support and/or drive wire 16.

Water is removed from the furnish disposed on wire 16 forming a wet web 24. One or more vacuum boxes, deflectors and hydro-foils (not shown) may be employed along upper flight 17 of wire 16 to assist in removal of water from web 24 during its formation.

Wet web 24, proximate the end of upper flight 17 of wire 16, is transferred to pickup felt 26 which is lightly pressed into engagement with web 24 on wire 16 by means of upper couch roll 28. Transfer of web 24 to felt 26 may be accomplished or assisted by other means such as an air knife or vacuum box (not shown), both means being well known.

Felt 26 moves in the same direction as wire 16 in a continuous path around upper couch roll 28 and press roll 30. One or more guide rolls (not shown) may also be used to support felt 26. At least one roll supporting felt 26 is driven to move felt 26 at a speed preferably substantially the same as wire 16. A guide board and showers (not shown) may be employed adjacent the surface of felt 26 to clean and condition the felt prior to pickup of web 24 as is well known.

In accordance with the invention, the apparatus includes compression means for partially dewatering the wet web to between about 30% to about 50% solids. As here embodied and depicted in FIG. 1, press roll 30 supporting felt 26 forms a nip 32 with smooth-surfaced transfer roll 34. Roll 34 is unheated. Web 24 is subjected to pressure in nip 32 between press roll 30 and transfer roll 34 to dewater web 24 to between about 30% to about 50% solids. Preferably, web 24 is dewatered to about 40% solids. Moisture removed from web 24 in nip 32 is transferred to felt 26 and is normally removed from the felt by a ringer (not shown), as is well known.

Figure 2:
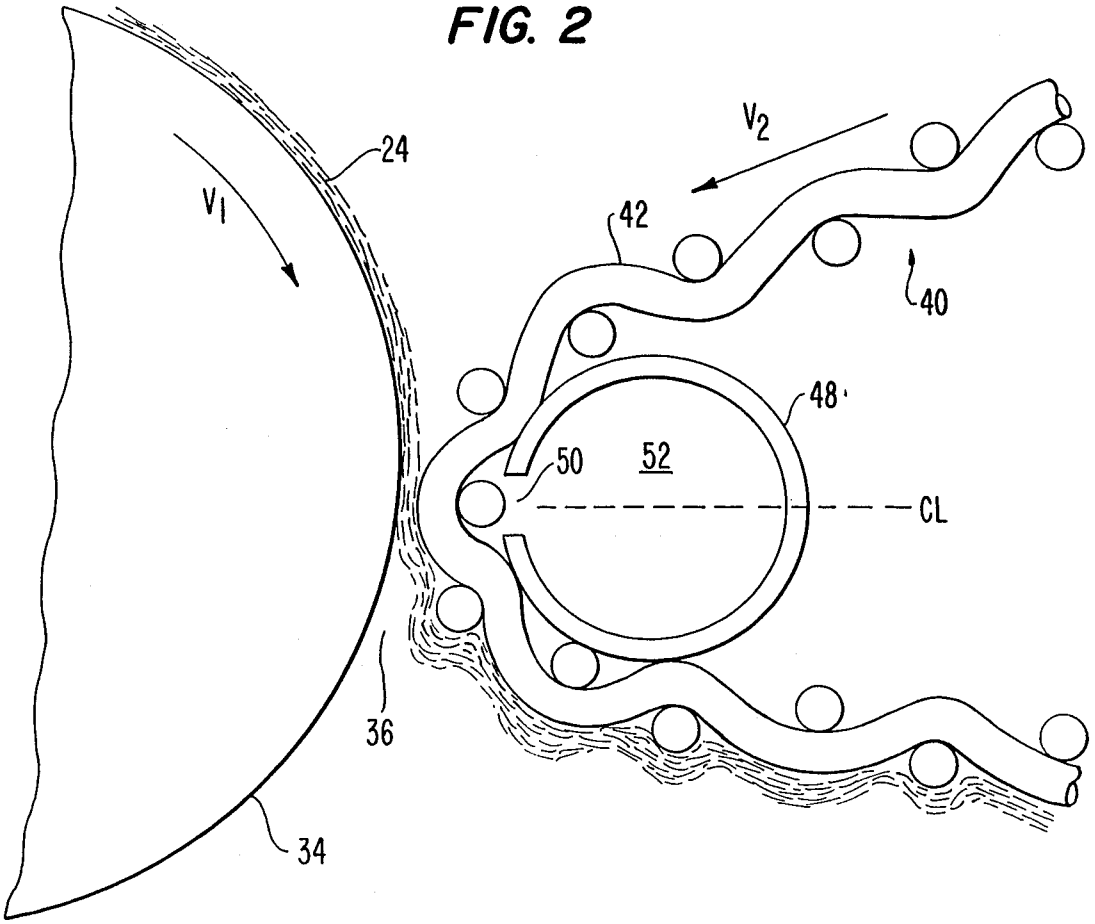
FIG. 2 is a schematic side elevation view of the embossing portion of the apparatus of FIG. 1.
Figure 4A:
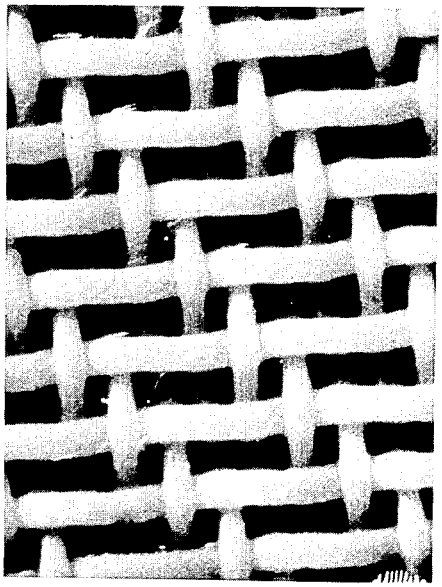
FIG. 4A is a photomicrograph of a fluid-pervious material useable in the method and appratus of the invention.

In accordance with the invention, the apparatus includes fluid-pervious support means having a three-dimensional surface and moving at a predetermined speed for receiving and imparting a three-dimensional pattern to the web and means for conveying the web from the compression means to the support means at a speed greater than the speed of the support means. Preferably, as depicted in FIGS. 1 and 2, the support means comprises a continuous loop of fluid-pervious material 40 having a three-dimensional-patterned, macroscopically-planar surface 42, such as an open-mesh imprinting fabric. The topography and geometric design of patterned surface 42 may be varied depending upon the desired appearance and properties of the resulting sheet material, providing material 40 remains pervious to fluid flow. One type of imprinting fabric is shown in FIG. 4A which is a photomicrograph, magnified 11.5 times, of the surface placed in contact with the web.

As depicted in FIG. 1, material 40 is supported for movement in a continuous loop by guide rolls 44, one or more of which may be driven to move material 40 around its loop at the predetermined speed. Stretch roll 46 may be employed to maintain desired tension on material 40.

Preferably, the conveying means comprises transfer roll 34. Due to its moisture content and preference for the smoother of the two surfaces, web 24 is transferred to the surface of transfer roll 34 at nip 32. Roll 34 is driven for rotation in the same direction and preferably at substantially the same speed as felt 26.

As depicted in FIG. 2, transfer roll 34 is disposed to form a non-compression nip 36 with material 40 which is moving around its loop in the same direction as the surface of roll 34 at a predetermined speed. The gap in the non-compression nip 36 is so set that the surface of material 40 barely contacts the exposed surface of web 24. The surface speed of transfer roll 34, and, therefore, the speed of web 24 at nip 36 must be greater than the predetermined speed of material 40. Preferably speed V1 of roll 34 is about 10% to about 40% greater than the speed V2 of material 40.

In an alternative embodiment, transfer roll 34 may be eliminated. In this arrangement, compression means for removing water may be provided by a nip between a press roll and back-up roll for felt 26 and downstream of the nip a non-compression nip may be formed between a felt-supporting roll and material 40.

In accordance with the invention, the apparatus includes embossing means for directly transferring the web from the conveying means to the support means and for generally conforming the web to the three-dimensional surface of the support means. As here embodied and depicted in FIG. 2, the embossing means comprises vacuum tube 48 disposed within the loop of material 40 to direct a vacuum through material 40 to web 24 at nip 36. The magnitude of the vacuum is sufficiently high to not only transfer web 24 to the surface of material 40, but also to substantially conform web 24 to the three-dimensionally-patterned surface 42. Tube 48 includes slot opening 50 for directing the vacuum in chamber 52 within tube 48 toward nip 36. Preferably, center line CL of slot 50 is oriented a few degrees downstream from the center of nip 36. The number of degrees will depend on the diameters of roll 34 and tube 48, slot width and web properties. In a preferred embodiment of a pilot machine where roll 34 has a diameter of 8 inches, tube 48 has a diameter of 2¼ inches, and slot 50 is ⅛ inch wide in machine direction and as long as the width of the web, the CL of slot 50 is 5 degrees downstream of the center of nip 36.

Web 24 is directly transferred from the surface of roll 34 to the surface 42 of material 40 primarily solely through application of vacuum from tube 48 through material 40 to web 24. The vacuum from tube 48 is sufficiently high not only to adhere web 24 to surface 42 of material 40, but also to conform web 24 to the patterned topography of surface 42 such that web 24 is embossed with the pattern of surface 42. The level of vacuum in chamber 52 is preferably between about 1 to about 20 inches of mercury. The force supplied by the vacuum web 24, of course, will vary depending upon the cohesive integrity and permeability of web 24 as well as the permeability of material 40. The level of vacuum should be chosen to apply sufficient force to web 24 to form the web over the knuckles and into the openings of material 40, thereby substantially conforming web 24 to the patterned topography of surface 42.

Figure 4B:
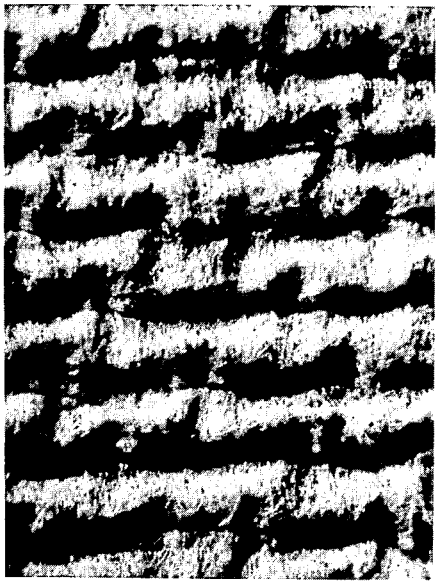
FIG. 4B is a photomicrograph of the product of the invention showing the side in contact with the material shown in FIG. 4A.
Figure 4C:
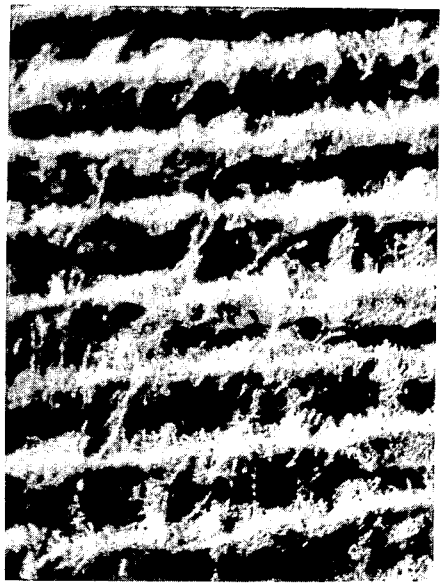
FIG. 4C is a photomicrograph of the opposite side of the product shown in FIG. 4B.

While the term "emboss" is used to describe the combined effect of surface 42 of material 40 and the vacuum, the term is intended to connote more than merely forming a pattern on a surface of web 24. The selected vacuum is at a level to thoroughly conform the entire web to the topography of surface 42 such that the emboss imparted to web 24 is generally throughout the thickness of web 24. The nature of the embossing may be seen by comparring FIGS. 4B and 4C which show that the three-dimensional pattern imposed on the web surface in contact with material 40 (FIG. 4B) is carried through to the web surface remote from material 40 (FIG. 4C).

In accordance with the invention, the apparatus includes means for drying the web after embossing. Preferably, material 40 carries web 24, after being embossed by surface 42, to a drying means. As depicted in FIG. 1, web 24 is carried to Yankee dryer 54 to which it is transferred and dried in a known manner. Alternatively, material 40 may carry web 24 to other drying apparatus, such as a through drier (not shown) or other conventional can dryers (not shown).

As depicted in FIG. 1, web 24 may be creped from Yankee dryer 54 by crepe blade 56 and then wound onto reel 58. Use of the crepe blade 56 is optional and not required to achieve the advantages of the invention.

THE METHOD

The method of the invention comprises the step of forming a wet fibrous web. Preferably, a dilute slurry of fibers and water is deposited on a flat, moving, foraminous surface, such as a Fourdrinier wire, to form a wet web of fibers, which is subsequently transferred to a moving felt. The fibers are preferably lignocellulosic but may also be other known synthetic fibers.

In accordance with the invention, the wet fibrous web is pressed to partially dewater it to between about 30% and about 50% solids. In the preferred embodiment, a lignocellulosic fiber web is pressed in a nip defined between the felt and a rotating roll. Water removed from the web is retained by the felt.

Other known methods may be used for forming a wet fibrous web and for partially dewatering the wet web to the required percentage of solids. Conventional wet pressing techniques are well known in the paper making industry. Such techniques, however, have been avoided when high bulk products are sought since wet pressing was thought to be inconsistent with the necessity of minimizing interfiber bonding in high bulk products. The method of this invention, however, provides a high bulk product with improved strength while using energy-efficient wet pressing to partially dewater the web before embossing. It is important to note that the web remains 70–50% wet for embossing. Overly drying the web through pressing will substantially reduce the effectiveness of subsequent embossing.

Further, in accordance with the invention, the method includes conveying the web to a transfer position proximate a three-dimensionally patterned surface of a moving fluid-pervious embossing fabric, the web moving at the transfer position in the same direction as and at a speed greater than the fabric, and applying a vacuum through the fabric to the web at the transfer position, the magnitude of the vacuum being sufficient to transfer and to generally conform the web to the surface of the fabric.

In the preferred embodiment, the web is moved at a predetermined speed to a position proximate the surface of the embossing fabric at which point the web is directly transferred to the fabric which is moving in the same direction as and at a speed less than the web. Direct transfer of the web to the embossing fabric permits constant support of the web throughout the process. The speed differential between the web and the embossing fabric provides additional web material to the embossing fabric permitting the web to conform to the topography of the embossing fabric without substantial stretching.

The pressing and transferring steps may be accomplished by a smooth-surfaced roll which is rotating at a surface speed generally equal to the speed at which the web is moving on the felt. A compression nip is defined between the felt and the roll for pressing the web as described above. At the compression nip, the web is transferred to the roll. The roll carries the web to a non-compression nip defined between the roll and the embossing fabric. At the non-compression nip, the web is directly transferred to the embossing fabric by application of the vacuum through the fluid-pervious fabric.

The embossing fabric may be of many known types which are fluid-pervious and have an undulating, patterned surface. One example may be seen in FIG. 4A. The vacuum not only transfers the web to the fabric surface, but also is of a magnitude sufficient to conform the web to the undulating, patterned surface of the fabric. The magnitude of vacuum necessary for this purpose depends upon the basis weight, cohesive integrity and permeability of the web. Preferably, the vacuum will be in the range of about 1 to about 20 inches of mercury. This magnitude of vacuum is substantially greater than is necessary to effect transfer of the web, but is necessary to form the web over the knuckles and into the openings of the fabric surface.

The fabric must have a surface speed at the non-compression nip at which transfer occurs which is less than the speed of the web entering the nip. In this way, the length of web entering the nip is greater than the length of fabric on which it is to be embossed.

A given fabric with a given surface topography requires a certain amount of extra web length for the web to conform to the fabric surface under the condition that the web is not stretched or contracted overall in the machine direction during the embossing process. The amount of applied vacuum for this condition is relatively small, enough to bring about the transfer of the web and to stretch the web in the cross machine direction in places where the fabric knuckles are located to achieve overall conformance. This condition of conformance serves as a base line for determining the desired speed differential, extra web length, and vacuum level, depending on the objectives and the results being sought.

An increase in vacuum only from this base line stretches the web deeper into the voids of the fabric resulting in higher bulk. A limiting factor in this case is not to stretch the factor to the point where the original length prior to embossing is exceeded at any local area of the web, otherwise a rupture of the web will be initiated. Furthermore, the effect of stretching in this case greatly reduces the stretch characteristics in the final product.

An increase in speed differential only from the base line conditions makes it easier for the vacuum to pull the web deeper into the fabric voids such that increases in bulk are attained at the existing relatively low level of vacuum. The limiting factor regarding stretch is alleviated. Upon further increases in speed differential, the web is forced into being shortened or contracted by ramming it into the cross machine filaments of the fabric, in particular, by virtue of the web's higher velocity relative to the velocity of the fabric. The extra lengths of the web in the case of contraction are visualized as being "stuffed"into the voids of the fabric to some extent. The limitation in this case lies in the amount of extra web length that the fabric can accommodate in such a manner under the existing level of vacuum. At still a higher speed differentials, the web has been observed to partially fold over on itself when apparently the capacity for such accommodation was exceeded.

In light of the foregoing, it follows that complementary or synergistic effects may be expected by increasing both speed differential and vacuum level from base line conditions. An increase in speed differential increases the efficiency of the vacuum in providing deeper emboss which in turn provides for further increase in differential speed. The application of different speed differentials in combination with different levels of vacuum can bring about a very wide range in effects on the end product properties with a given fabric and/or given starting web.

Thus, the nature and basis weight of the web, the geometry of the embossing fabric, the speed differential and the vacuum level are all variables which interrelate and which may be adjusted to provide the desired product. In the preferred embodiment, the web speed is about 10% to about 40% greater than the fabric speed.

Finally, in accordance with the invention, the web is dried. Drying of the web after it has been conformed to the faric surface may be accomplished by many known methods. Preferably, the embossed web is transferred to a Yankee dryer.

THE PRODUCT

The method and apparatus of the invention produce a bulky, embossed fibrous web product having a unique balance of physical properties. Specifically, the product of the invention comprises a web of randomly arranged, contacting fibers bonded together in patterned undulations substantially throughout the thickness of the web. The product has exceptionally high bulk and tensile strength relative to its stretch and liquid holding capacity. When compared to conventional creped products, the product of the invention is approximately twice as bulky and twice as strong and has significantly higher permeability and absorption capacity at comparable tensile strengths. Additionally, the product of the invention has higher extensional stiffness and total energy absorption (TEA) than conventionally creped products while having comparable load-elongation curve characteristics.

Because of the unique embossing techniques of the invention, the embossed characteristics of the product are not confined to its surfaces but rather extend essentially through the whole thickness of the web. The geometry and topography of the embossing material determines the embossed characteristics.

Test results of an extensive experimental program demonstrate the advantages of the invention over conventional products. Forty runs were performed on apparatus as depicted in FIGS. 1 and 2 at speed differentials of 0%, 10%, 20%, and 25%. In addition, nine runs were performed to manufacture conventionally wet-pressed uncreped web and six runs were performed to manufacture conventionally wet-pressed, 20% creped webs. All of the webs were wet-pressed, prior to embossing or creping, to about 40% solids. The webs had a basis weight ranging from approximately eight pounds to approximately 31 pounds per ream as indicated in the tabulated results. The webs were manufactured from identical 100% Marathon furnish consisting of 60% bleached softwood kraft and 40% bleached hardwood kraft pulp. The felt used in manufacturing the webs and the fabric used in embossing the webs that were embossed were the same for all of the webs. None of the webs which were embossed in accordance with the method of the invention were subsequently creped. Each web was then subjected to identical tests to determine the characteristics tabulated in the Table I.

| | RUN NO. | SPEED DIFF %ΔS | BASIS WEIGHT lb/ream | CAL. 8-PLY .001" | BULK CAL. PTS/ lb ream | TENSILE, g/3" MD | TENSILE, g/3" CD | TENSILE, g/3" GM | % STRETCH MD | % STRETCH CD |
|---|---|---|---|---|---|---|---|---|---|---|
| | 2141 | | | | | | | | | |
| | 9 | 25 | 14.08 | 93.8 | .833 | 1960 | 1660 | 1800 | 30.3 | 2.8 |
| | 10 | 20 | 13.42 | 93.8 | .874 | 2100 | 1600 | 1830 | 23.6 | 3.1 |
| | 11 | 10 | 11.77 | 72.5 | .770 | 2500 | 1840 | 2140 | 12.5 | 3.0 |
| | 12 | 0 | 10.90 | 44.5 | .510 | 3500 | 2100 | 2700 | 4.3 | 2.1 |
| | 13 | 0 | 8.47 | 39.3 | .580 | 2330 | 1300 | 1740 | 4.1 | 2.0 |
| | 14 | 10 | 9.53 | 64.8 | .850 | 1620 | 1210 | 1400 | 10.9 | 2.3 |
| | 15 | 20 | 10.32 | 87.3 | 1.057 | 1160 | 950 | 1050 | 21.6 | 3.0 |
| | 16 | 25 | 11.11 | 89.3 | 1.005 | 1010 | 1040 | 1020 | 28.3 | 3.0 |
| | 17 | 0 | 13.10 | 43.8 | .418 | 4390 | 2740 | 3470 | 4.7 | 2.2 |
| | 18 | 10 | 14.34 | 74.8 | .652 | 3570 | 2270 | 2850 | 12.1 | 2.7 |
| | 19 | 20 | 15.69 | 92.3 | .735 | 2650 | 2190 | 2410 | 23.7 | 3.1 |
| | 20 | 25 | 16.15 | 89.0 | .689 | 2600 | 2200 | 2390 | 28.8 | 3.0 |
| | 21 | 0 | 14.86 | 47.3 | .398 | 5600 | 3000 | 4100 | 4.4 | 2.3 |
| | 22 | 10 | 16.17 | 79.0 | .611 | 4170 | 2430 | 3190 | 12.6 | 2.6 |
| E | 23 | 20 | 17.53 | 92.3 | .659 | 3370 | 2160 | 2700 | 23.3 | 2.9 |
| | 24 | 25 | 18.79 | 97.3 | .647 | 3160 | 2510 | 2610 | 30.1 | 3.1 |
| | 25 | 0 | 15.70 | 46.5 | .370 | 6220 | 3320 | 4540 | 4.6 | 2.4 |
| | 26 | 10 | 17.08 | 78.3 | .573 | 4840 | 2710 | 3620 | 12.5 | 2.4 |
| | 27 | 20 | 19.25 | 93.8 | .609 | 3740 | 2690 | 3170 | 23.8 | 2.9 |
| | 28 | 25 | 20.08 | 97.5 | .607 | 3590 | 2960 | 3260 | 30.9 | 2.8 |
| | 2142 | | | | | | | | | |
| | 29 | 0 | 15.93 | 51.1 | .401 | 6160 | 3090 | 4360 | 4.4 | 2.5 |
| D | 30 | 10 | 17.29 | 85.9 | .621 | 4590 | 2630 | 3470 | 13.4 | 2.9 |
| | 31 | 20 | 18.87 | 105.5 | .699 | 3620 | 2560 | 3050 | 23.9 | 3.0 |
| | 32 | 25 | 19.88 | 115.9 | .729 | 3530 | 2210 | 2800 | 29.3 | 3.0 |
| C | 33 | 0 | 18.05 | 54.8 | .380 | 7360 | 3730 | 5240 | 5.3 | 2.7 |
| | 34 | 10 | 19.10 | 84.4 | .522 | 5430 | 3140 | 4130 | 13.5 | 2.9 |
| | 35 | 20 | 21.50 | 111.1 | .646 | 4320 | 3030 | 3620 | 24.6 | 3.0 |
| | 36 | 25 | 22.20 | 118.9 | .669 | 3890 | 2700 | 3240 | 30.7 | 3.1 |
| | 37 | 0 | 19.40 | 55.6 | .358 | 8100 | 3930 | 5640 | 5.1 | 2.5 |
| | 38 | 10 | 21.53 | 87.3 | .507 | 5870 | 3550 | 4560 | 12.9 | 2.8 |
| | 39 | 20 | 24.10 | 112.3 | .582 | 5210 | 3750 | 4420 | 24.4 | 3.1 |
| | 40 | 25 | 24.64 | 117.6 | .597 | 4930 | 3370 | 4080 | 31.5 | 3.0 |
| | 41 | 0 | 22.45 | 54.5 | .303 | 9180 | 4680 | 6560 | 4.7 | 2.3 |
| | 42 | 10 | 23.73 | 89.0 | .469 | 6920 | 4020 | 5270 | 14.1 | 2.9 |
| | 43 | 20 | 27.11 | 115.8 | .534 | 5790 | 3810 | 4700 | 24.7 | 3.3 |
| | 44 | 25 | 28.12 | 119.3 | .530 | 4980 | 4010 | 4470 | 29.4 | 3.2 |
| | 45 | 0 | 24.07 | 56.0 | .291 | 10740 | 5230 | 7490 | 5.3 | 2.7 |
| | 46 | 10 | 26.12 | 90.3 | .432 | 7220 | 4490 | 5690 | 13.1 | 2.7 |
| | 47 | 20 | 29.77 | 114.0 | .479 | 7020 | 4170 | 5410 | 25.4 | 3.2 |
| | 48 | 25 | 30.81 | 120.9 | .491 | 5460 | 4130 | 4750 | 29.9 | 3.5 |
| | 2143 | CONVENTIONAL UNCREPED | | | | | | | | |
| | 1 | | 8.28 | 13.8 | .208 | 2070 | 1460 | 1740 | 2.1 | 1.7 |
| | 2 | | 10.52 | 15.6 | .185 | 3480 | 2190 | 2760 | 2.4 | 1.9 |
| | 3 | | 12.42 | 17.1 | .172 | 4590 | 2760 | 3560 | 2.9 | 1.8 |
| | 4 | | 13.68 | 18.8 | .172 | 5840 | 3350 | 4420 | 3.4 | 2.1 |
| | 5 | | 15.03 | 19.8 | .165 | 6260 | 3800 | 4880 | 3.2 | 2.3 |
| A | 6 | | 17.50 | 21.9 | .156 | 7660 | 4660 | 5970 | 3.9 | 2.6 |
| | 7 | | 20.47 | 24.0 | .147 | 9190 | 4720 | 6590 | 3.8 | 2.5 |
| | 8 | | 22.16 | 25.5 | .144 | 9330 | 5530 | 7180 | 3.3 | 2.6 |
| | 9 | | 25.41 | 28.0 | .138 | 13410 | 7240 | 9850 | 3.9 | 2.7 |
| | 2145 | CONVENTIONAL CREPED 20% | | | | | | | | |
| | 1 | | 9.49 | 39.1 | .515 | 420 | 370 | 390 | 20.8 | 4.6 |
| | 2 | | 12.26 | 45.4 | .463 | 650 | 560 | 600 | 21.6 | 3.8 |
| B | 3 | | 17.19 | 56.3 | .409 | 1450 | 880 | 1130 | 24.3 | 3.9 |
| | 4 | | 20.14 | 63.8 | .396 | 2020 | 1320 | 1510 | 25.1 | 3.9 |
| | 5 | | 25.10 | 59.4 | .296 | 2660 | 1440 | 1950 | 25.6 | 3.9 |
| | 6 | | 30.50 | 83.8 | .343 | 3720 | 1630 | 2470 | 26.2 | 4.1 |

| RUN | TOTAL ENERGY ABSORPTION TEA. in-g | NULL SOFT g(1" wide) | EXTENTIONAL STIFFNESS (LOAD-ELONGATION SLOPE) MD | CD | OIL HOLD CAPACITY | AIR PERM. |
|---|---|---|---|---|---|---|

-continued

| | NO. | MD | CD | MD | CD | INITIAL | FINAL | OVERALL | ml/g | Fpm ΔH = .5% |
|---|---|---|---|---|---|---|---|---|---|---|
| | 2141 | | | | | | | | | |
| | 9 | 59 | 53 | .75 | 7.20 | 500 | 6900 | 28500 | 9.1 | — |
| | 10 | 54 | 50 | .72 | 5.70 | 600 | 9100 | 25400 | 8.9 | — |
| | 11 | 42 | 50 | 1.00 | 5.60 | 3000 | 12800 | 32600 | 8.3 | — |
| | 12 | 32 | 42 | 1.50 | 2.50 | 7900 | 28300 | 52800 | 6.5 | — |
| | 13 | 20 | 28 | .86 | 1.80 | 7000 | 20700 | 31800 | 8.1 | 134 |
| | 14 | 26 | 32 | .69 | 2.80 | 800 | 8100 | 23700 | 9.6 | 162 |
| | 15 | 31 | 33 | .57 | 3.30 | 700 | 4900 | 14900 | 11.7 | 216 |
| | 16 | 33 | 39 | .42 | 3.90 | 400 | 3800 | 15800 | 11.7 | 200 |
| | 17 | 40 | 56 | 2.40 | 8.30 | 9600 | 34300 | 66600 | 5.6 | 37 |
| | 18 | 56 | 52 | 1.50 | 7.60 | 2700 | 19100 | 46100 | 6.8 | 44 |
| | 19 | 62 | 64 | 1.00 | 8.20 | 900 | 11500 | 38700 | 7.4 | 58 |
| | 20 | 70 | 64 | .85 | 7.40 | 700 | 10200 | 38300 | 7.7 | 52 |
| | 21 | 60 | 62 | 3.20 | 5.30 | 14300 | 45500 | 66100 | 5.0 | — |
| | 22 | 68 | 60 | 2.10 | 10.70 | 2700 | 22500 | 50400 | 6.1 | — |
| E | 23 | 76 | 68 | 1.20 | 11.00 | 1000 | 14600 | 36800 | 6.8 | — |
| | 24 | 86 | 68 | 1.20 | 12.20 | 700 | 12700 | 43200 | 6.6 | — |
| | 25 | 64 | 70 | 3.60 | 7.20 | 10000 | 45300 | 78500 | 4.8 | 21 |
| | 26 | 78 | 74 | 2.00 | 10.10 | 3200 | 25000 | 49800 | 5.7 | 26 |
| | 27 | 90 | 72 | 1.20 | 14.30 | 15600 | 45400 | 6.3 | 36 | |
| | 28 | 100 | 82 | 1.20 | 13.60 | 8100 | 13600 | 54900 | 5.8 | 34 |
| | 2142 | | | | | | | | | |
| | 29 | 64 | 72 | 4.20 | 5.40 | 10700 | 47400 | 63000 | 4.9 | 27 |
| D | 30 | 80 | 70 | 2.40 | 11.60 | 2800 | 22800 | 49500 | 6.0 | 31 |
| | 31 | 82 | 78 | 1.40 | 14.90 | 900 | 15400 | 39800 | 7.3 | 41 |
| | 32 | 86 | 70 | 1.30 | 14.90 | 700 | 14100 | 36100 | 7.4 | 43 |
| C | 33 | 102 | 92 | 5.00 | 8.20 | — | 44400 | 81300 | 4.4 | — |
| | 34 | 96 | 82 | 2.90 | 13.40 | 3400 | 26600 | 55200 | 5.7 | — |
| | 35 | 98 | 92 | 1.70 | 15.90 | 1000 | 19000 | 50200 | 6.5 | — |
| | 36 | 100 | 86 | 1.40 | 16.80 | 700 | 14800 | 39700 | 6.8 | — |
| | 37 | 102 | 90 | 7.30 | 8.60 | — | 49000 | 82000 | 4.5 | 13 |
| | 38 | 106 | 94 | 3.50 | 18.30 | 4200 | 29700 | 62400 | 5.1 | 16 |
| | 39 | 120 | 108 | 2.20 | 18.80 | 1300 | 22200 | 54600 | 5.9 | 24 |
| | 40 | 132 | 100 | 1.70 | 20.00 | 800 | 18100 | 47400 | 6.0 | 27 |
| | 41 | 122 | 110 | 8.90 | 13.00 | — | 62600 | 90100 | 4.3 | — |
| | 42 | 134 | 104 | 4.00 | 23.50 | 4500 | 23000 | 68000 | 4.7 | — |
| | 43 | 144 | 114 | 2.40 | 20.00 | 1500 | 21700 | 49900 | 5.2 | — |
| | 44 | 134 | 120 | 2.30 | 23.60 | 1100 | 19600 | 55000 | 5.1 | — |
| | 45 | 140 | 134 | 12.00 | 12.40 | — | 68600 | 114700 | 3.9 | 7 |
| | 46 | 136 | 128 | 5.00 | 25.90 | 5600 | 34500 | 83500 | 4.7 | 13 |
| | 47 | 176 | 122 | 2.90 | 27.20 | 1800 | 25000 | 61000 | 4.9 | 18 |
| | 48 | 156 | 126 | 2.60 | 27.70 | 1300 | 19700 | 57100 | 5.0 | 18 |
| | 2143 | | | | | | | | | |
| | 1 | 12 | 27 | .46 | .33 | 21100 | | 3900 | 5.6 | 96 |
| | 2 | 13 | — | .84 | .69 | — | | — | 4.5 | 34 |
| | 3 | 40 | 52 | 1.10 | .89 | 55700 | | 67400 | 4.2 | — |
| | 4 | — | — | 2.20 | 1.60 | — | | — | 3.6 | * |
| | 5 | 70 | 98 | 2.90 | 1.80 | 78900 | | 90700 | 3.4 | — |
| A | 6 | — | — | 4.00 | 2.90 | — | | — | 3.4 | — |
| | 7 | 120 | 132 | 6.00 | 3.50 | 100400 | | 124200 | 4.2 | * |
| | 8 | 114 | 150 | 7.80 | 4.70 | 96300 | | 149600 | 3.6 | — |
| | 9 | 162 | 148 | 13.80 | 7.80 | 149500 | | 121600 | 3.5 | * |
| | 2145 | | | | | | | | | |
| | 1 | 19 | 19 | .10 | .46 | 1000 | 500 | 3900 | 9.2 | 229 |
| | 2 | 29 | 25 | .15 | .66 | 1300 | 800 | 7000 | 7.7 | 125 |
| B | 3 | 60 | 42 | .29 | 1.20 | 1600 | 1200 | 10700 | 7.0 | 58 |
| | 4 | 78 | 51 | .42 | 1.80 | 1800 | 2900 | 14400 | 6.5 | 38 |
| | 5 | 96 | 74 | .56 | 3.80 | 2100 | 3600 | 21700 | 6.0 | 23 |
| | 6 | 130 | 80 | .78 | 5.50 | 2500 | 3900 | 20800 | 5.7 | 17 |

*OUTSIDE RANGE

The unique property balance of the product of the invention when compared to other products is illustrated by Table I and the graphs of FIGS. 5–18.

For ease of comparison, five webs having approximately the same basis weight were selected. These webs are labled A through E in the Table I. Web A was dried without creping or embossing. Web B was conventionally creped. Web C was embossed by the method of the invention but without a speed differential. Webs D and E were embossed in accordance with the method of the invention, Web D at a 10% speed differential and Web E at a 20% speed differential. Webs C, D and E were embossed using the same embossing fabric.

The advantages of the invention are evident when comparing the measured values for webs A–E for apparent bulk, machine direction (MD) tensile strength, cross-machine direction (CD) tensile strength, MD stretch, CD stretch and oil holding capacity (OHC). Apparent bulk was determined by measuring the caliper of a stack containing 8 webs using an anvil two inches in diameter and a pressure under the anvil of 27.1 grams per square centimeter and dividing the caliper by the basis weight of the stack of 8 webs. Apparent bulk is expressed in 0.001 inches (caliper point) per round ream of 3000 square feet.

Tensile strength was determined by an Instron Tensile Tester using a 3 inch wide strip with a 3 inch span between the jaws at an elongation rate of 8 inches per minute for machine direction (MD) samples and of 2 inches per minute for the cross machine (CD) samples. Tensile strength is expressed in grams per 3 inches of width. Stretch was determined by the Instron Tester simultaneously with the tensile test and is expressed as a percentage of initial unstretched length.

Oil holding capacity is a ratio determined by the Van den Akker method which is based on a water holding capacity test method developed by J. A. Van den Akker which has been submitted to ASTM for certification. It is a measure of the amount of oil held by a specimen after immersion in the oil and extraction of excess under suction head of 5 mm of water. The oil is dimethylpolysiloxane of 0.934 grams/milliliter density. OHC is expressed in mililiters of oil per gram of fiber.

Tabulated below are the results of measurements on the five webs.

TABLE II

| CHARACTERISTICS | A | B | C | D | E |
|---|---|---|---|---|---|
| Basis Weight, lb/ream | 17.5 | 17.2 | 18.1 | 17.3 | 17.5 |
| Apparent Bulk, cal pts./lb ream | .156 | .409 | .380 | .621 | .659 |
| MD Tensile, gm/3" | 7660 | 1450 | 7360 | 4590 | 3370 |
| CD Tensile, gm/3" | 4660 | 880 | 3730 | 2630 | 2160 |
| MD Stretch, % | 3.9 | 24.3 | 5.3 | 13.4 | 23.3 |
| CD Stretch, % | 2.6 | 3.9 | 2.7 | 2.9 | 2.9 |
| Oil Holding Capacity Ratio, ml/g | 3.4 | 7.0 | 4.4 | 6.0 | 6.8 |

TABLE II

The difference in the properties between Webs A and B in Table II illustrates the effect of creping in the conventional wet press paper making process. The increase in apparent bulk was more than two-fold. The liquid holding capacity as reflected by OHC was also more than doubled while stretch in machine direction (MD) was increased several fold. The associated loss in tensile strength was very substantial. The crepe strength was only about 1/5 of the uncreped strength.

The effect of vacuum embossing of a wet pressed web is depicted by the properties of Web C as compared to Web A. The main effect is one of increasing apparent bulk, comparable to that obtained with creping. Increases in stretch and OHC were minor in comparison. Reduction in strength was also relatively small. The vacuum wet emboss, the method of the invention without the speed differential, primarily provides bulk with little loss in strength, while not significantly affecting stretch or liquid holding capacity.

Webs D and E represent vacuum embossing with speed differential in accordance with the invention. The results clearly illustrate the unique balance in properties. Both Webs D and E were significantly higher in bulk, more than 50%. Web E, in particular was twice as strong as the crepe Web B in spite of it being about equal in stretch and OHC.

FIGS. 3A–3E are photo-microtomes of cross-sections of samples of Webs A–E, respectively. The magnification is about 15 times and thus the photographs represent an actual length of web of about 0.4 inches. The cross-section seen in FIGS. 3A–3E support the physical property data presented in the Tables.

The tensile strength of the web is dependent on the extent of fiber-bonding within it. The closer or more tightly packed the fiber, the stronger the web, and vice versa. Webs A and B which reflect the effect of creping represent the two extremes. Web A is the strongest because its fibers were tightly packed and bonded together while Web B had the lowest strength due to a considerable amount of fiber separation caused by fracturing during creping. Web C indicates a slight increase in fiber separations as compared to Web A, while Webs D and E show more but not to the extent as in B. Thus, the photo-microtomes provide visual evidence which is in agreement with the measured tensile strength.

Similarly, the photo-microtomes support the tabulated conclusions with respect to apparent bulk. Measuring apparent bulk is performed by measuring the cross-section of a stack of webs under some compression. Thus, it is apparent from the photo-microtomes that Web A would have the lowest bulk and Webs B and C would have approximately the same bulk since those webs have comparable shallow undulations. The undulations are deeper and more contorted with the introduction of speed differentials in the case of Webs D and E, supporting the higher bulk figures for these two webs.

In comparing the photo-microtomes of Web A and Web C in FIG. 3, greater stretch for Web C would be expected than was measured. While the reason is not known, it is possible that the weaker localized areas in Web C caused earlier failure due to uneven distribution of the tensile load in contrast to the uniform structure of Web A. The photo-mictrotomes of Webs B and E in FIG. 3 do not appear to be helpful in explaining why the stretch values for those webs were essentially the same. It may be that pulling a web having a large number of shallow undulations (Web B) is equivalent to pulling a web having a smaller number of deeper undulations (Web E). The OHC results are more difficult to explain. Oil, unlike water, does not cause any appreciable swelling of the fibers, nor does it appreciably alter the integrity and shape characteristics of a fibrous web as a whole. Consequently, differences in OHC ratios from one web to another made from the same fibers are generally attributed to differences in total void volumes between the fibers within the web. It is not known to what extent this may apply to irregular webs such as those considered in this test.

Figure 3A:
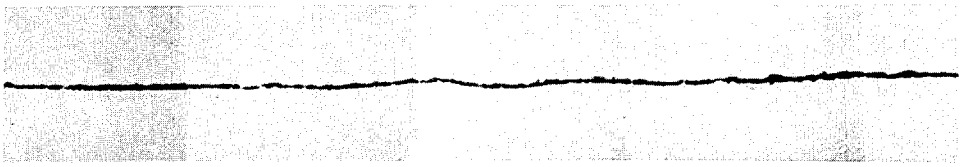
FIG. 3A is a photo-microtome of a cross-section of fiber sheet material manufactured by a conventional wet-press method.
Figure 3B:
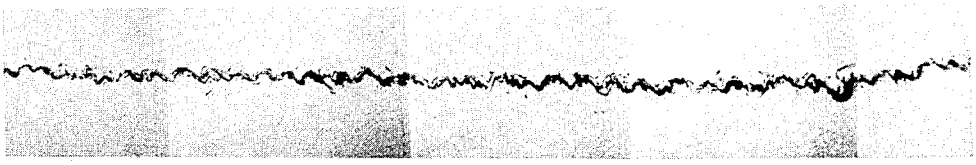
FIG. 3B is a photo-microtome of a cross-section of fiber sheet material having a 20% conventional crepe.
Figure 3C:
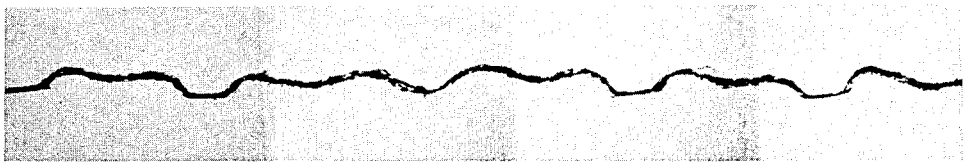
FIG. 3C is a photo-mictrotome of a cross-section of fiber sheet material embossed in a manner similar to the method of the invention but without the speed differential.
Figure 3D:
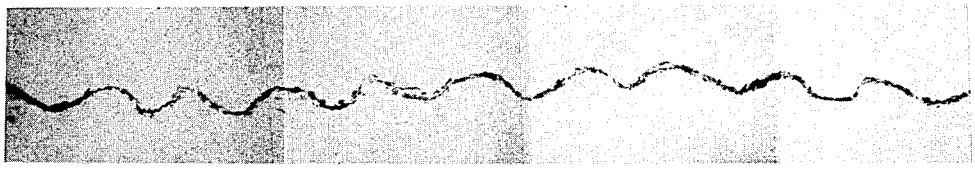
FIG. 3D is a photo-microtome of a cross-section of fiber sheet material of the invention manufactured using the method of the invention at a 10% speed differential.
Figure 3E:
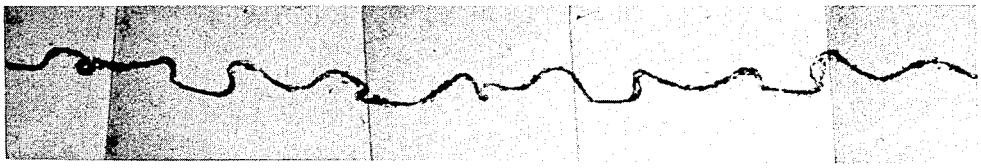
FIG. 3E is a photo-microtome of a cross-section of fiber sheet material of the invention manufactured using the method of the invention at a 20% speed differential.

The creped Web B possesses the highest interfiber void volume both from observing its cross-section in FIG. 3B and from the fact that its tensile strength was the lowest. This is substantiated by Web B having the highest OHC ratio. Judging from its appearance in FIG. 3E, Web E had lower void volume than Web B and the test results established that it had a higher tensile strength than Web B, yet the OHC ratio for both webs was essentially the same. The undulations apparently contribute in some way towards increasing the OHC. It may be that oil was confined in locations where Web E took sharp bends or was nearly folded over on itself in which case the additional holding capacity of Web E is external to the web volume. The supposition may be supported by comparison of Web E with Web C. The latter had deep undulations but they were gently sloped and did not exhibit abrupt bends as in Web E. This would support a lower OHC ratio for Web C. Indeed, Web C had an OHC ratio only slightly greater than Web A which had no undulations at all. The undulations of the type in Web C therefore do not contribute significantly to OHC.

It may be seen from the above test information that the product of the invention is a substantial improvement over conventional products where bulk is desired. Webs of comparable basis weight, manufactured in accordance with the claimed method, provide a product having an apparent bulk and tensile strength substantially greater than conventionally creped products at comparable stretch values.

In order to more clearly depict the advantages of the product of the invention, the data in Table I has been used to prepare graphic comparisons between the invention and conventional products. The graphs in FIGS. 5–18 provide these comparisons.

Figure 5:
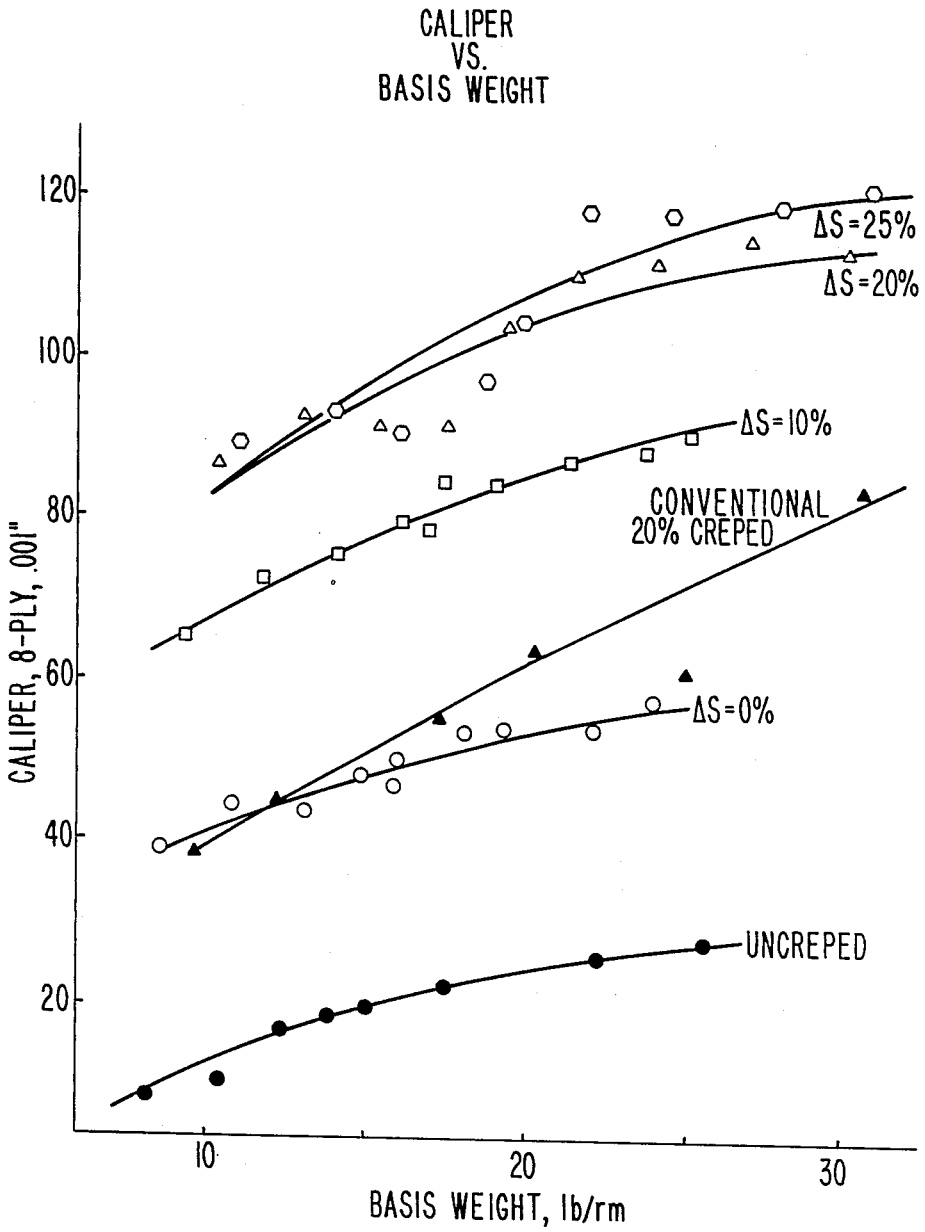
FIGS. 5–18 are graphic representations of the characteristics of the fibrous sheet material of the invention and of conventional sheet material.
Figure 6:
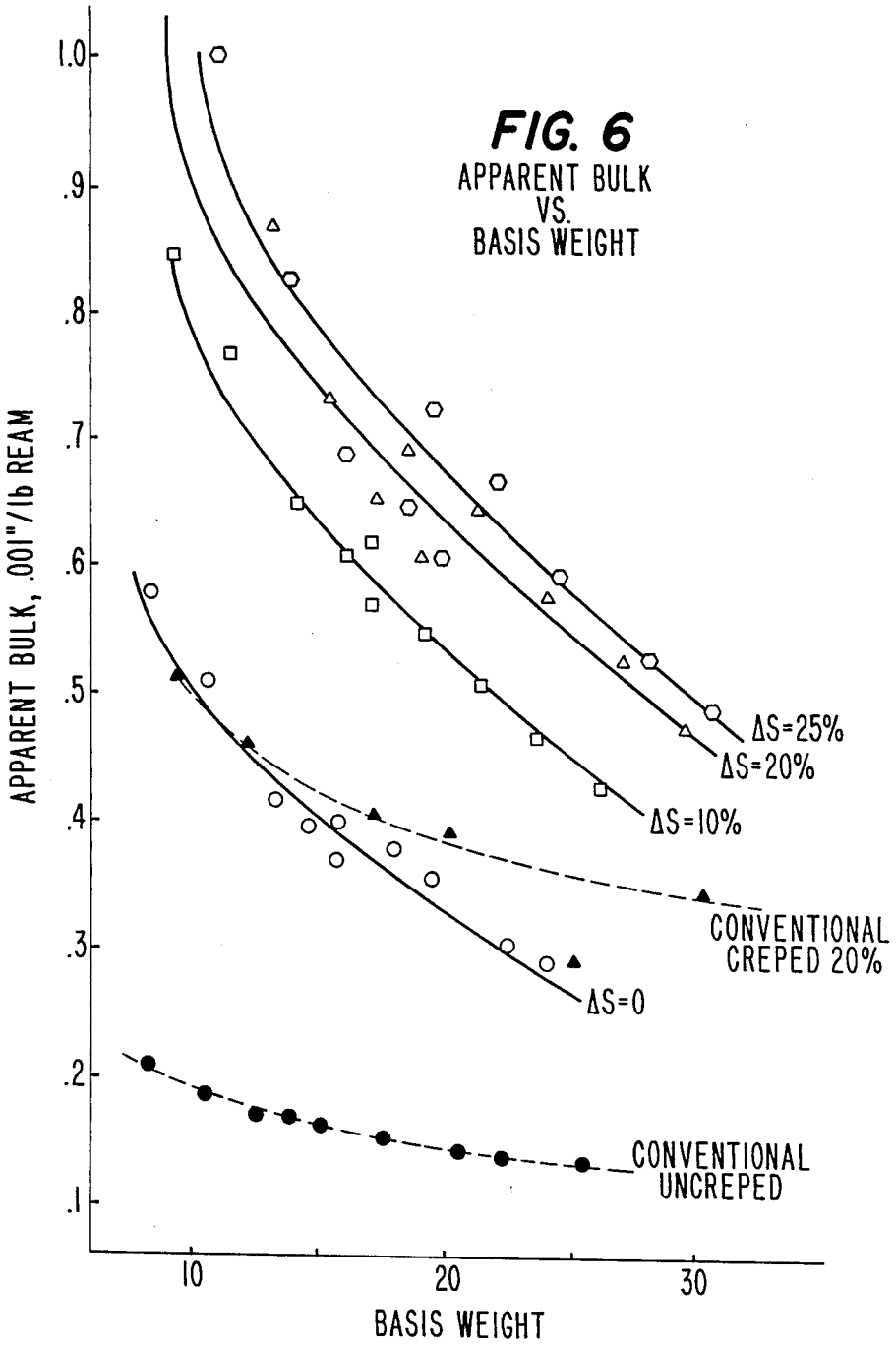

As graphically depicted in FIGS. 5 and 6, the creped web and the web manufactured at zero speed differential on the apparatus of the invention have a bulk that is similar while the products of the invention manufactured in accordance with the method have a bulk nearly twice that of the creped webs. The difference in bulk is the greatest at the lower basis weight levels.

Figure 7:
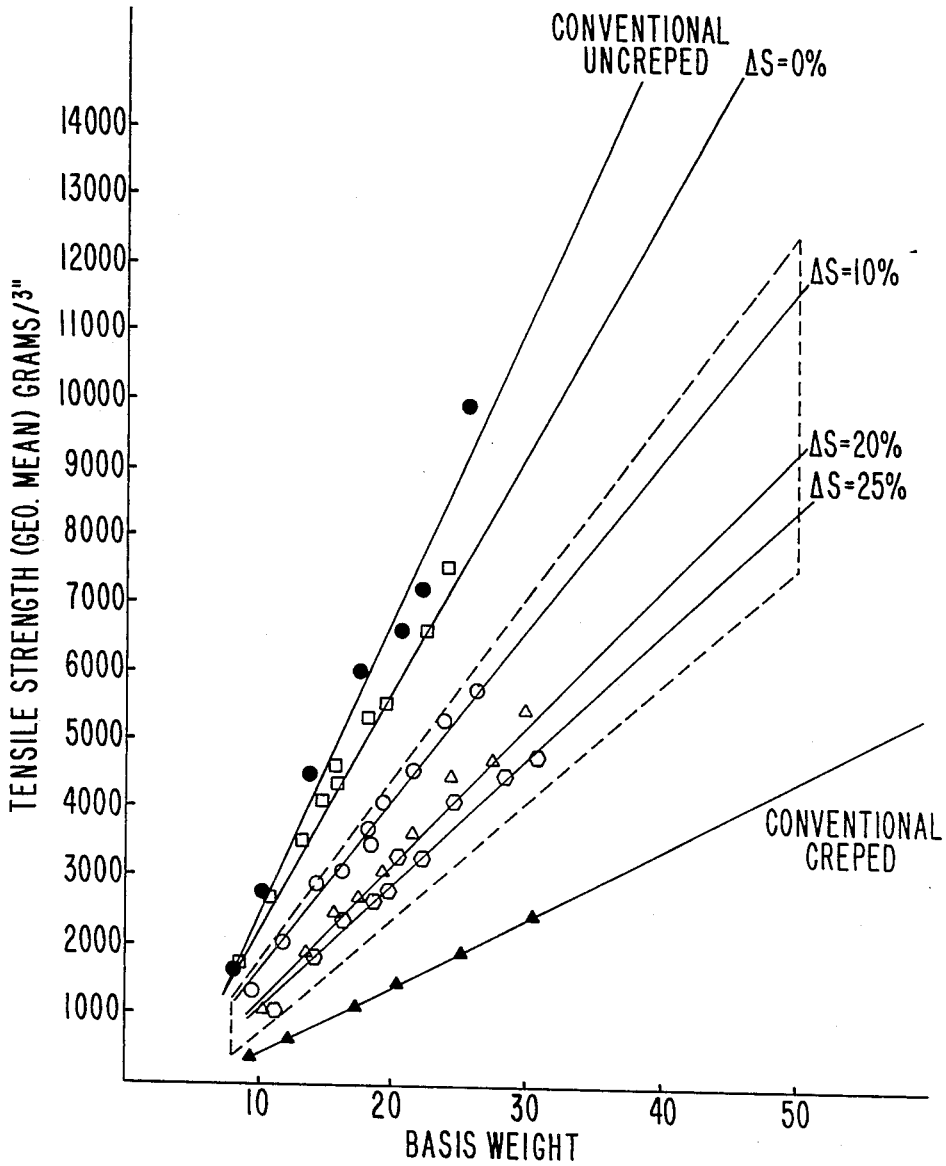
Figure 8:
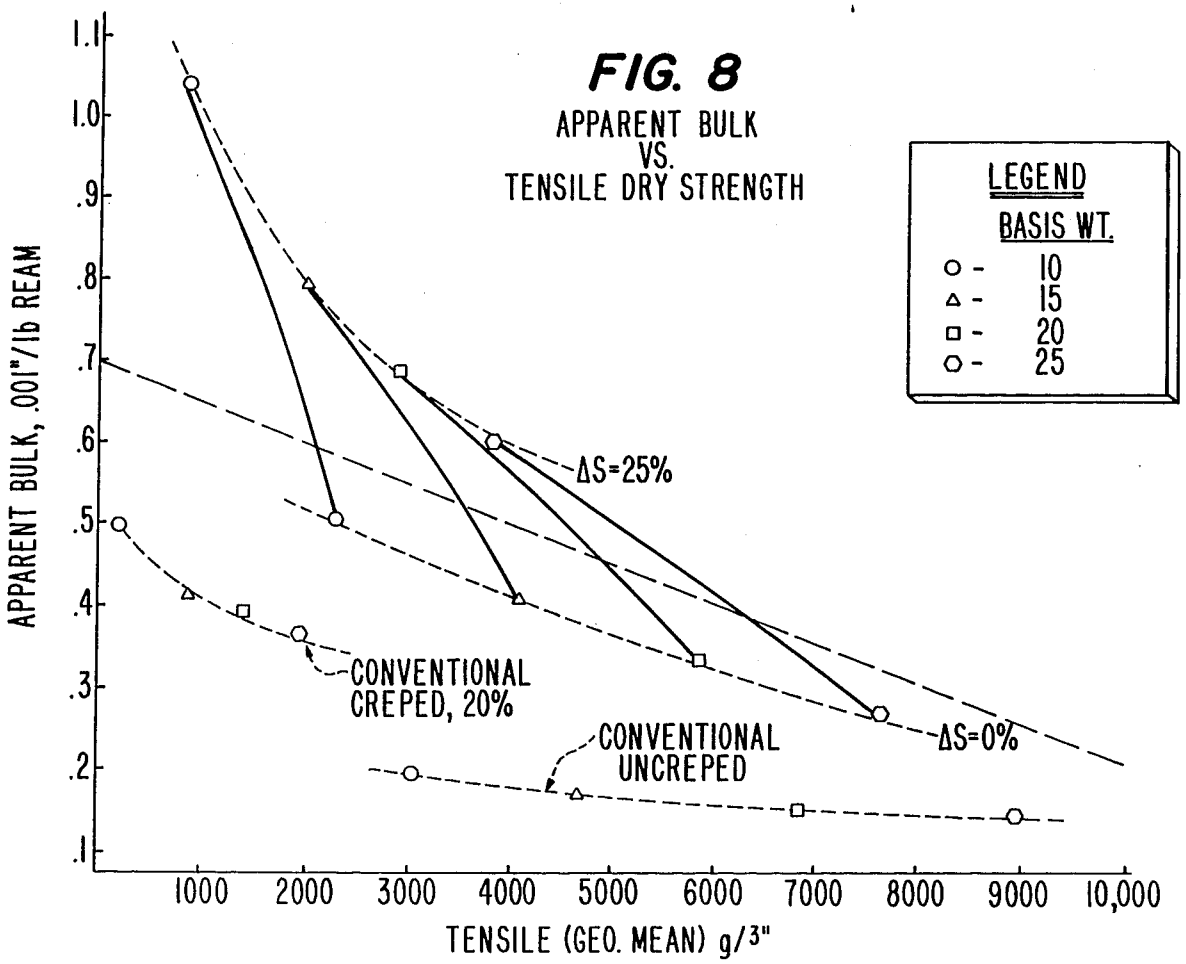
Figure 9:
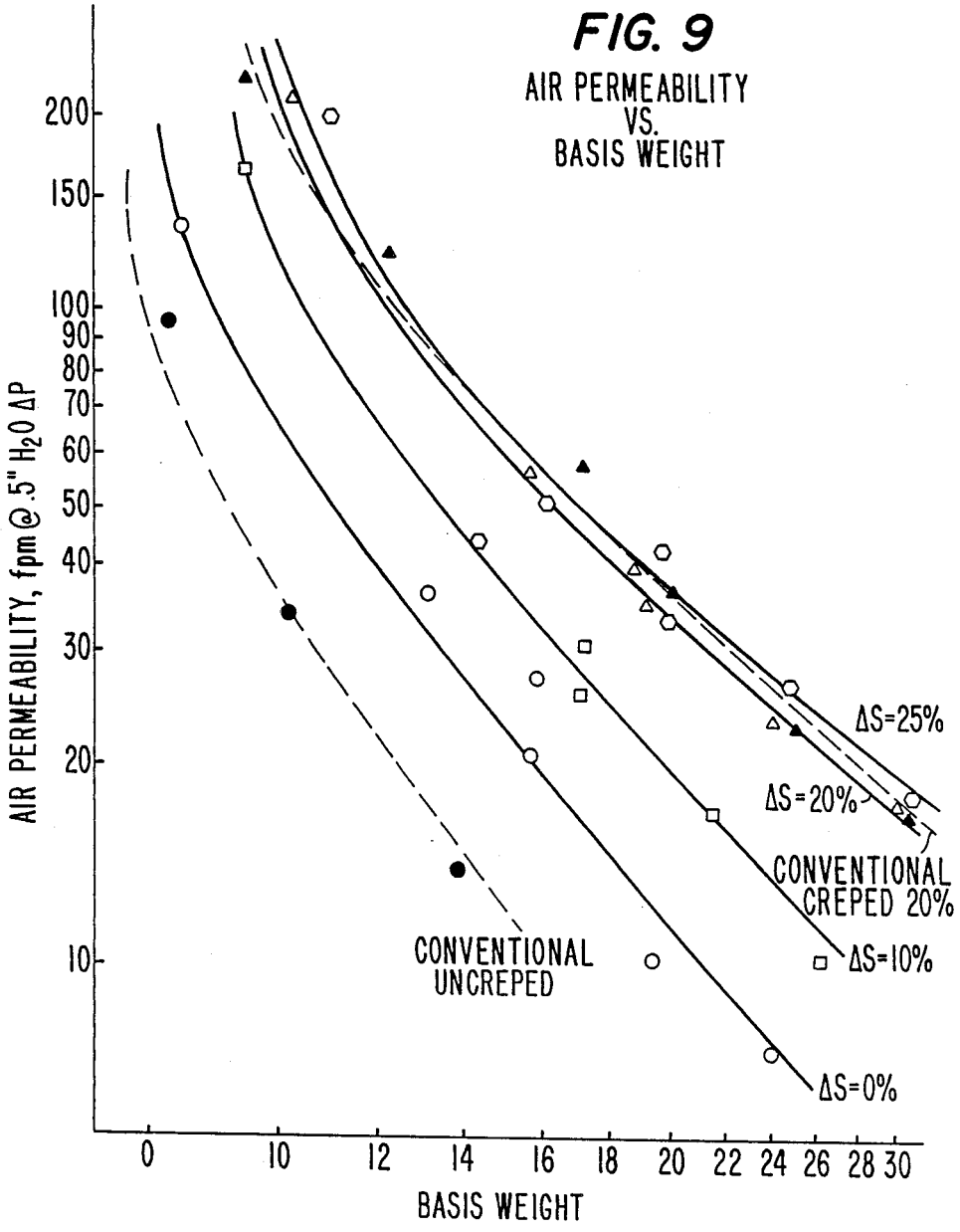
Figure 10:
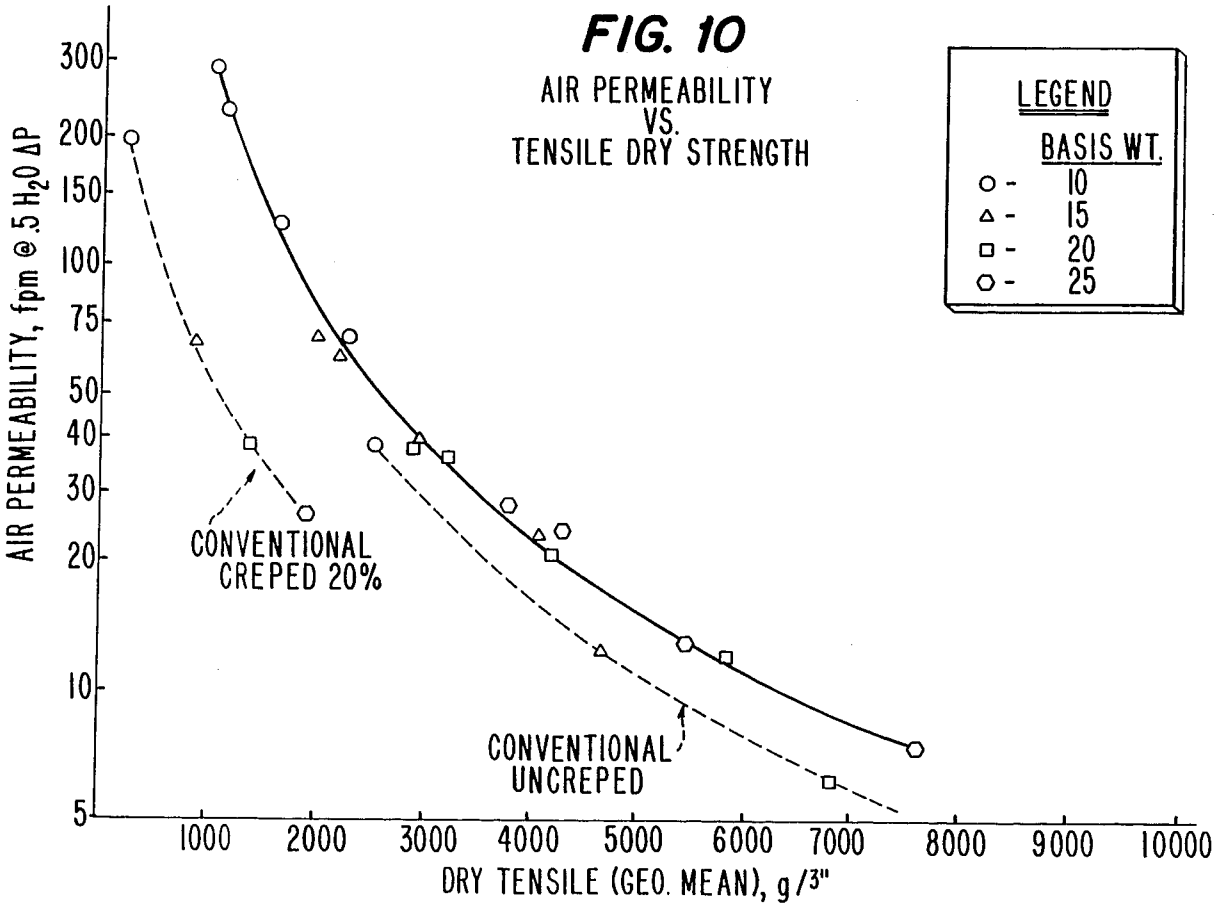

FIG. 7 graphically depicts the geometric mean (GM) tensile strength relationships between the products of the invention and conventionally creped and uncreped webs. The relation between geometric mean (GM), machine direction (MD) and cross machine (CD) tensile strength is $GM=\sqrt{MD\times CD}$. The GM tensile strength for the web manufactured at zero speed differential is nearly the same as for the uncreped web. Products manufactured with speed differentials, in accordance with the invention, have lower tensile strength due to mechanical decompacting or debonding of the fibers, but the tensile strength is significantly greater than conventionally creped webs. FIG. 8 graphically demonstrates that at a given GM tensile strength the bulk for the product of the invention is higher than that for a creped sheet. The higher the speed differential the greater the difference.

Air permeability of a web is also an important feature of high bulk products. As demonstrated in FIGS. 9 and 10, the products of the invention manufactured at the higher speed differentials (20% and 25%) have air permeability approximately the same as the 20% creped sheet per a given basis weight. At a given tensile strength, the products of the invention have a higher air permeability than uncreped sheets. By varying the basis weight levels and speed differential levels, the same combination of air permeability and tensile strength may be obtained.

Figure 11:
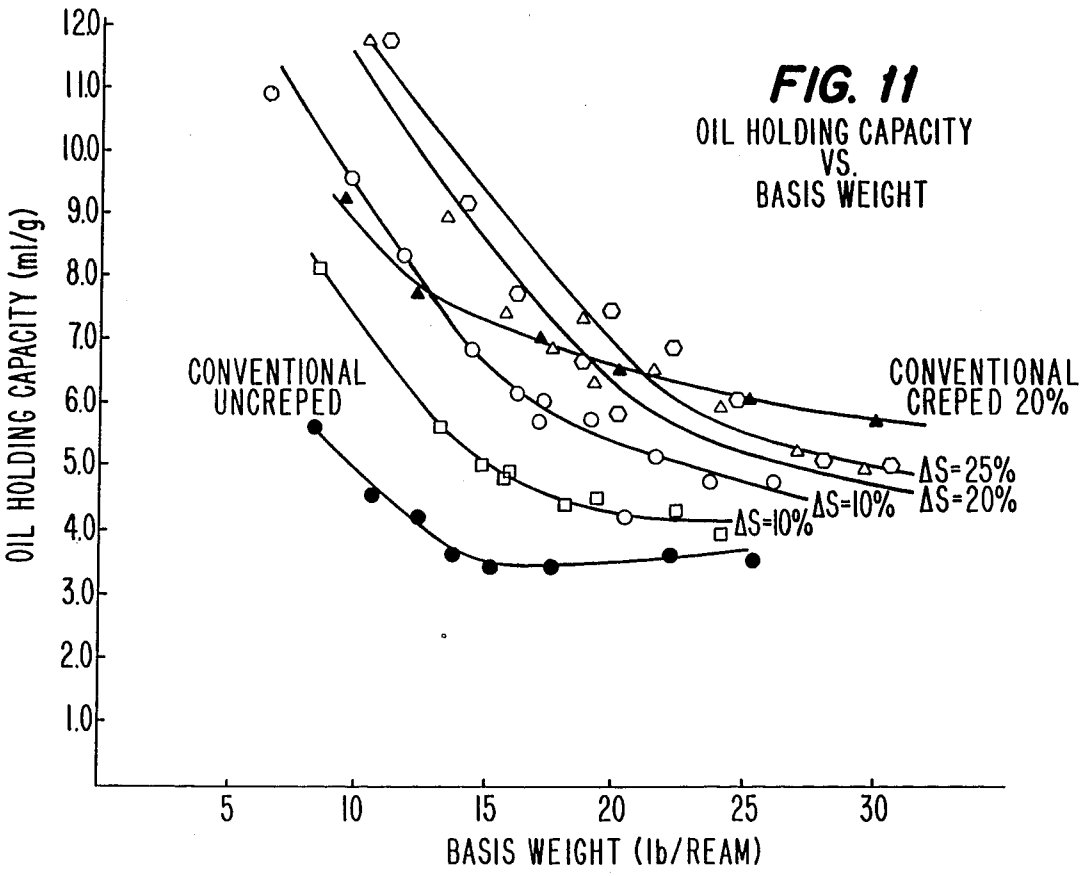
Figure 12:
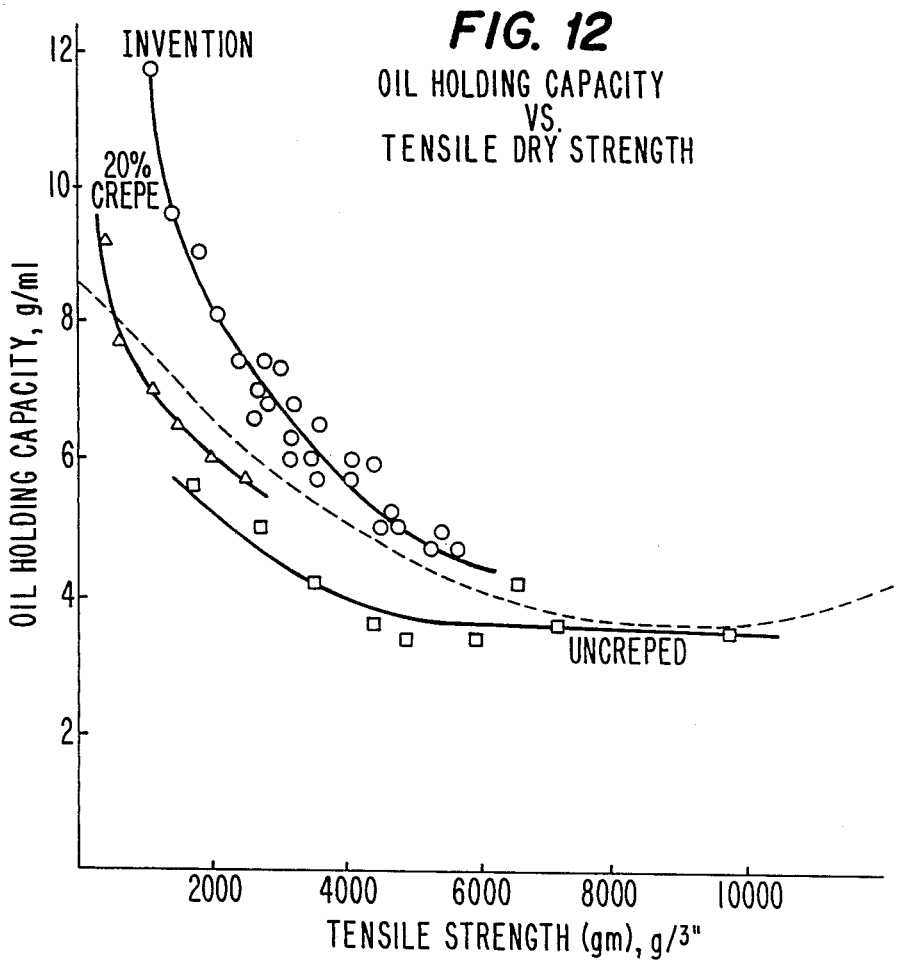

FIG. 11 graphically presents oil holding capacity versus basis weight. FIG. 11 is similar to FIG. 6 except for the results of the creped web which have lower apparent bulk values. The oil holding capacity ratio (OHC) reflects sheet bulk in the uncompressed stated in contrast to the bulk values computed from caliper readings where some compression takes place. This explains the variation in the results for creped webs as between FIGS. 6 and 11 as creped webs are more easily compressed. FIG. 12 shows a curve for oil-holding capacity ratio versus tensile strength which is remarkably similar to FIG. 10 reflecting a relationship between oil-holding capacity and air permeability. As previously explained, oil-holding capacity reflects void volume and the greater void volume, the more permeable the web.

Figure 13:
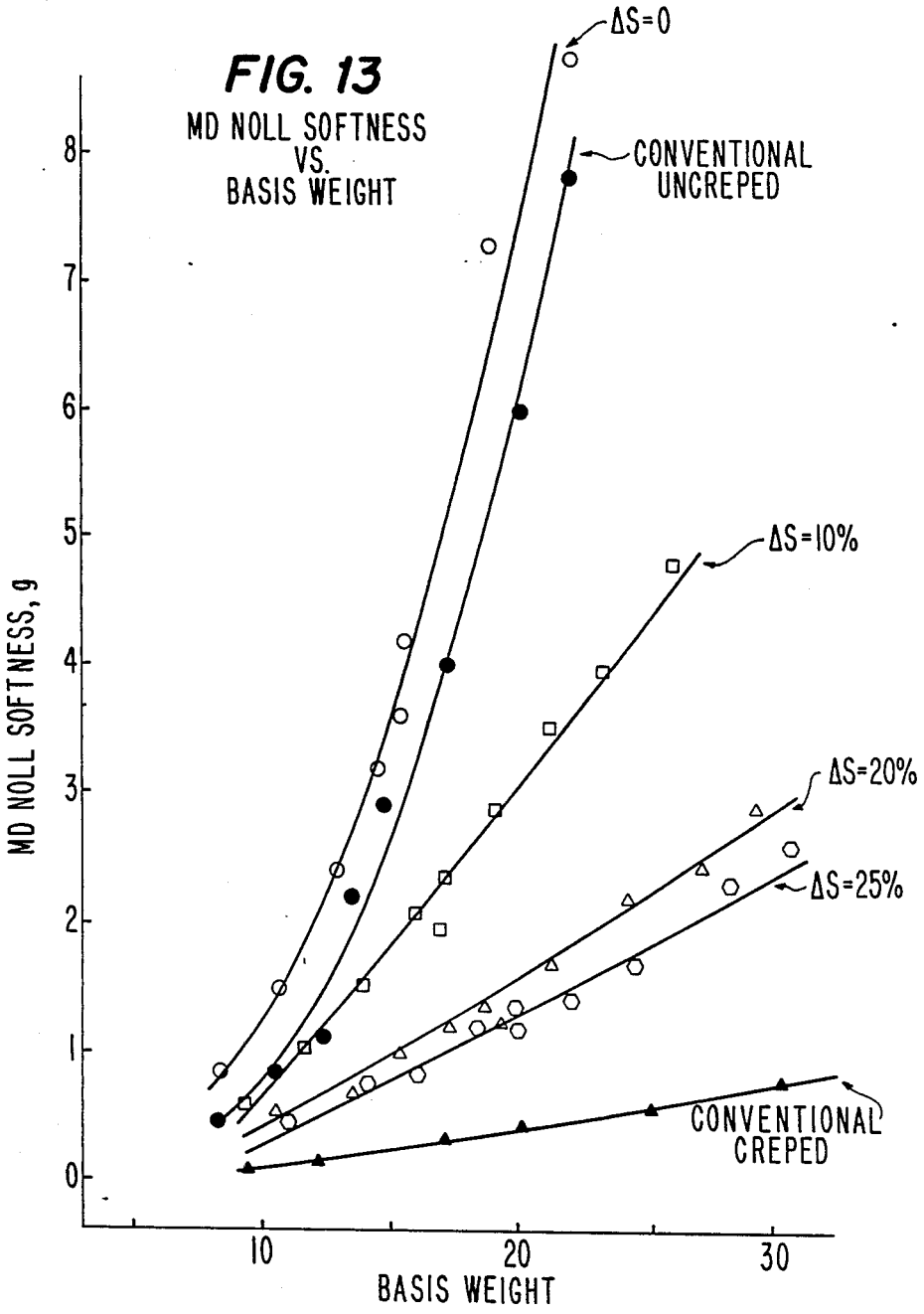
Figure 14:
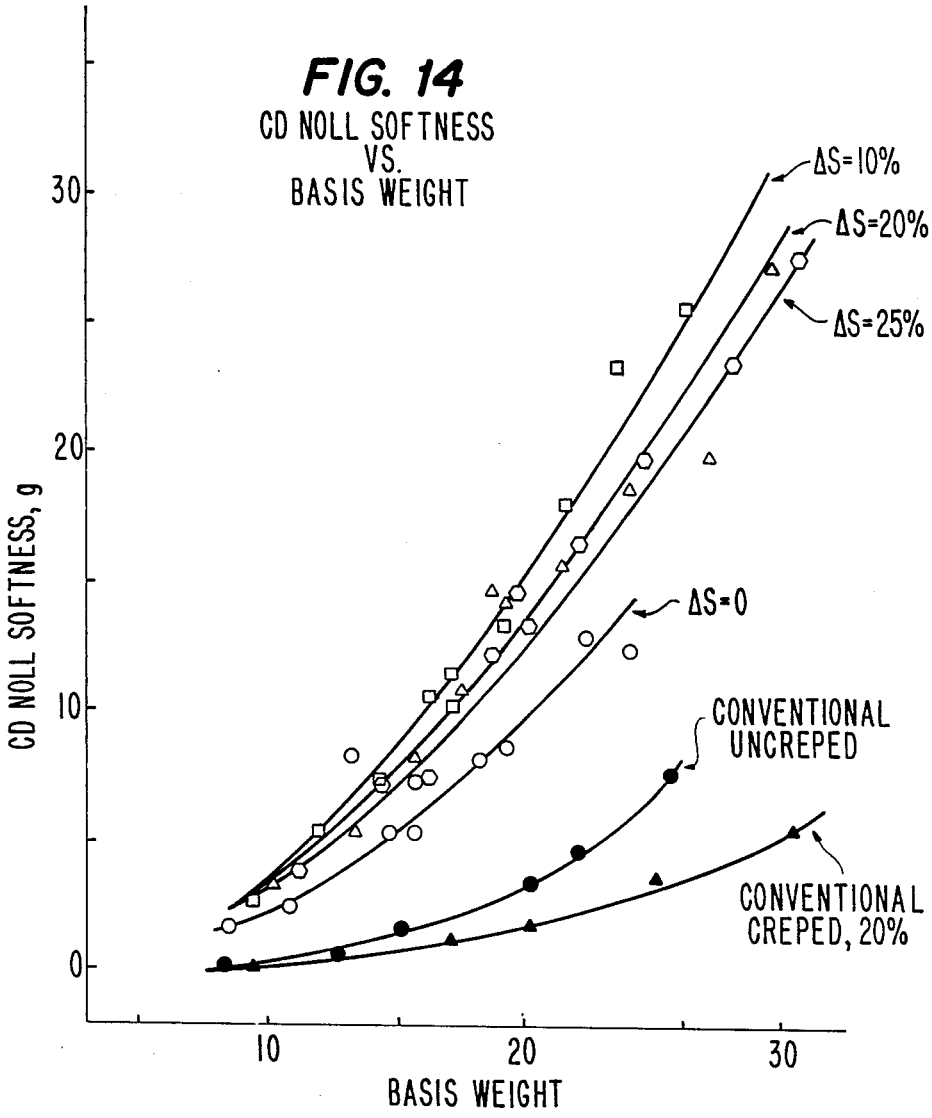

Noll softness is a measure of the sheets buckling force. The lower the Noll softness the softer the sheet. Noll softness is determined by a method and apparatus developed by Robert Noll. The apparatus is commercially available. As previously discussed, softness is obtained at the expense of tensile strength in conventional products. FIGS. 13 and 14 indicate that the products manufactured in accordance with the invention are not as soft as creped products and, as seen in FIG. 7, have higher tensile strength than creped products.

Figure 15:
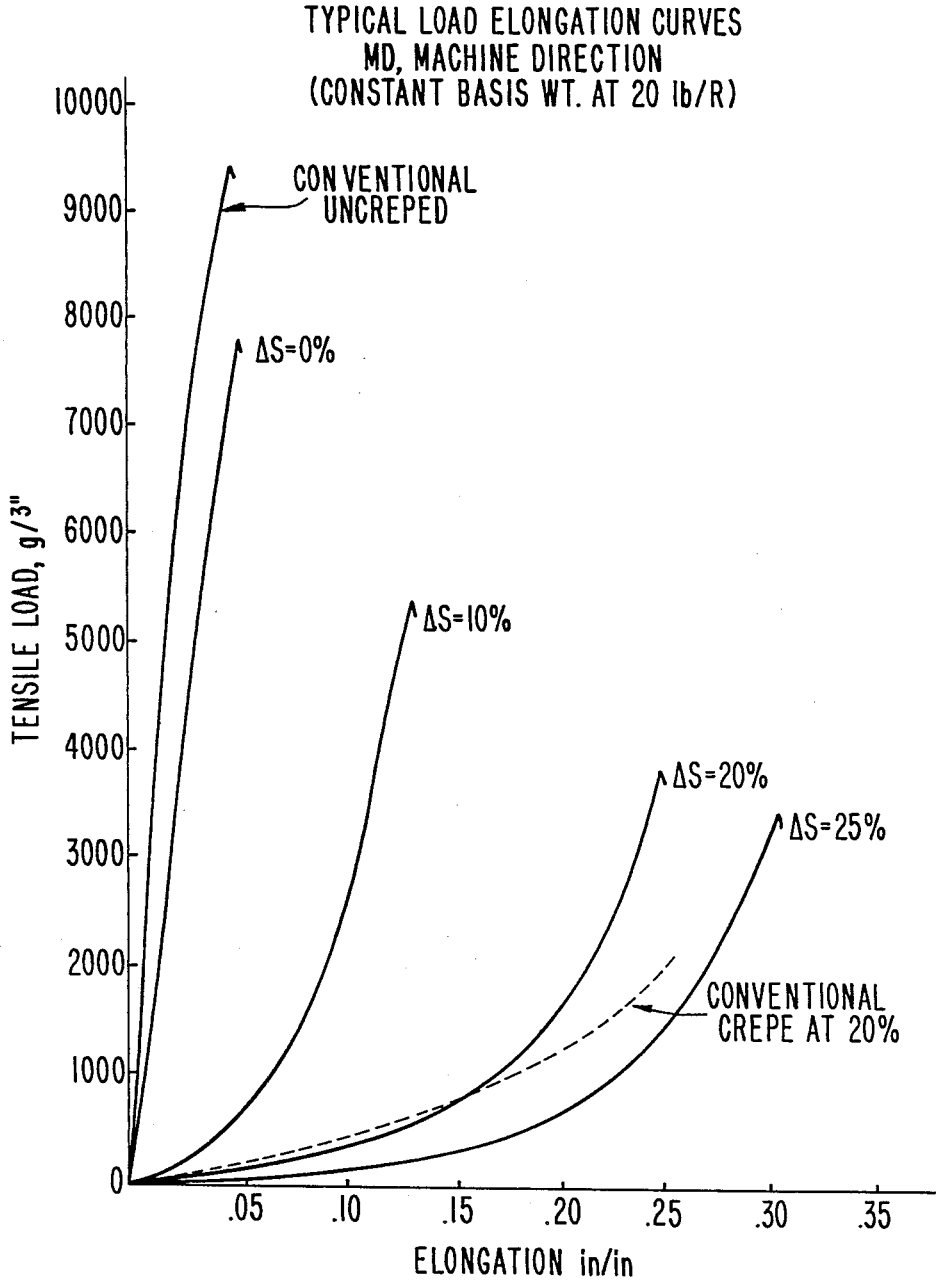
Figure 16:
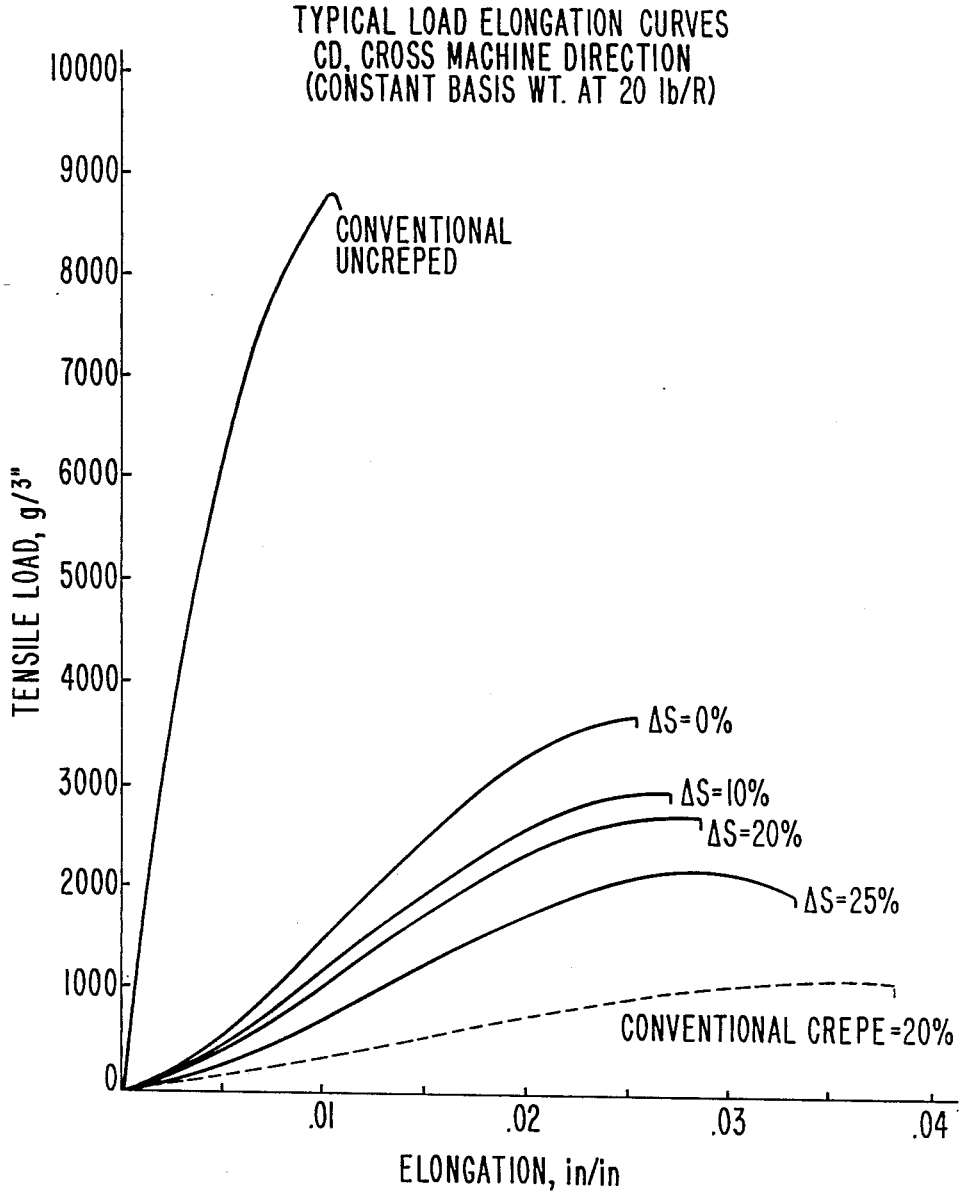

FIG. 15 graphically shows typical load elongation curves in the machine direction at a constant basis weight. The products of the invention show the same characteristics as creped products, that is, there is a low slope in the beginning and a higher slope towards the end of the curve before failure. FIG. 16 graphically shows typical load elongation curves in the cross machine direction at a constant basis weight. These curves do not exhibit the radical changes in slope as in the machine direction and are similar to curves for most materials, including regular paper.

Figure 17:
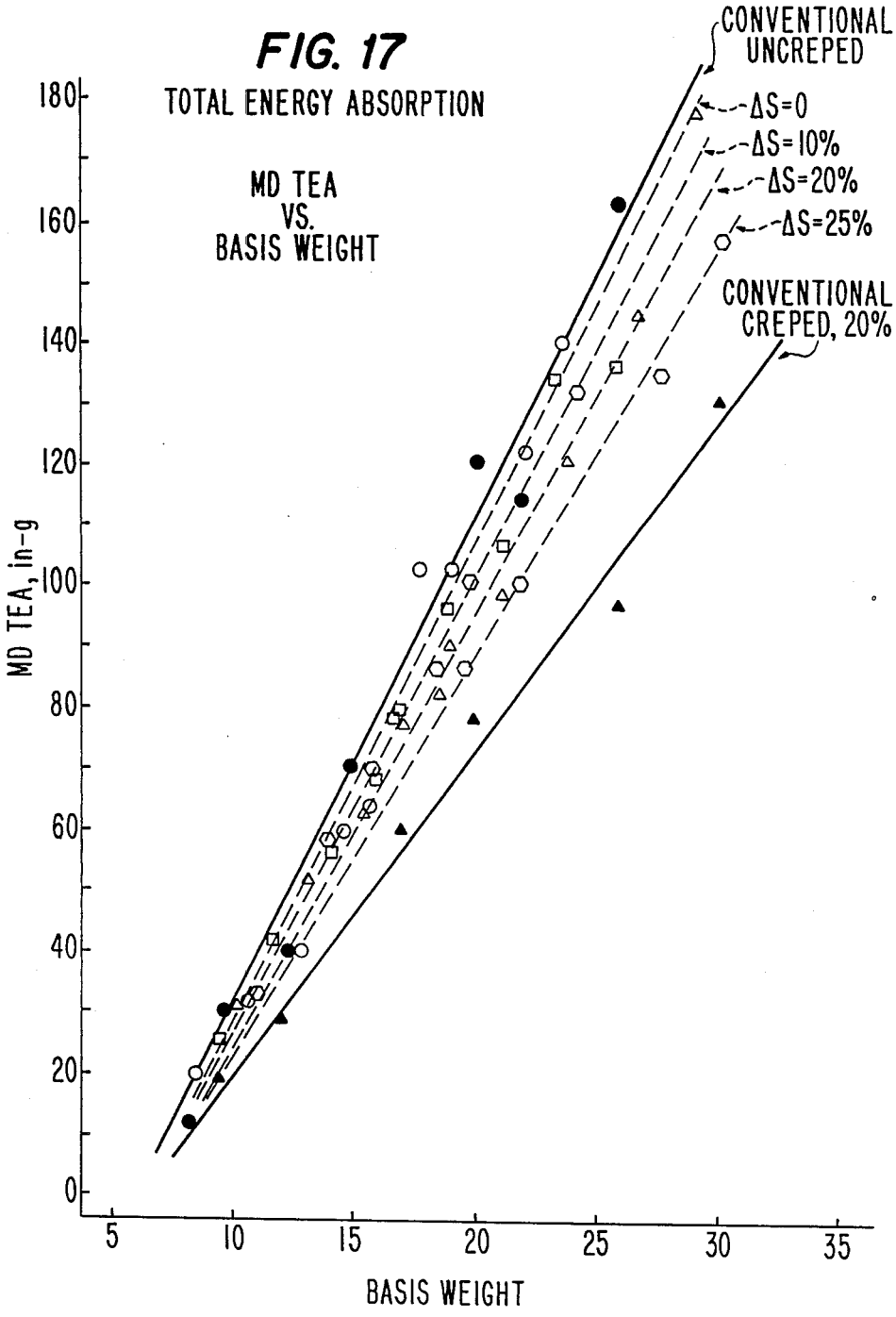
Figure 18:
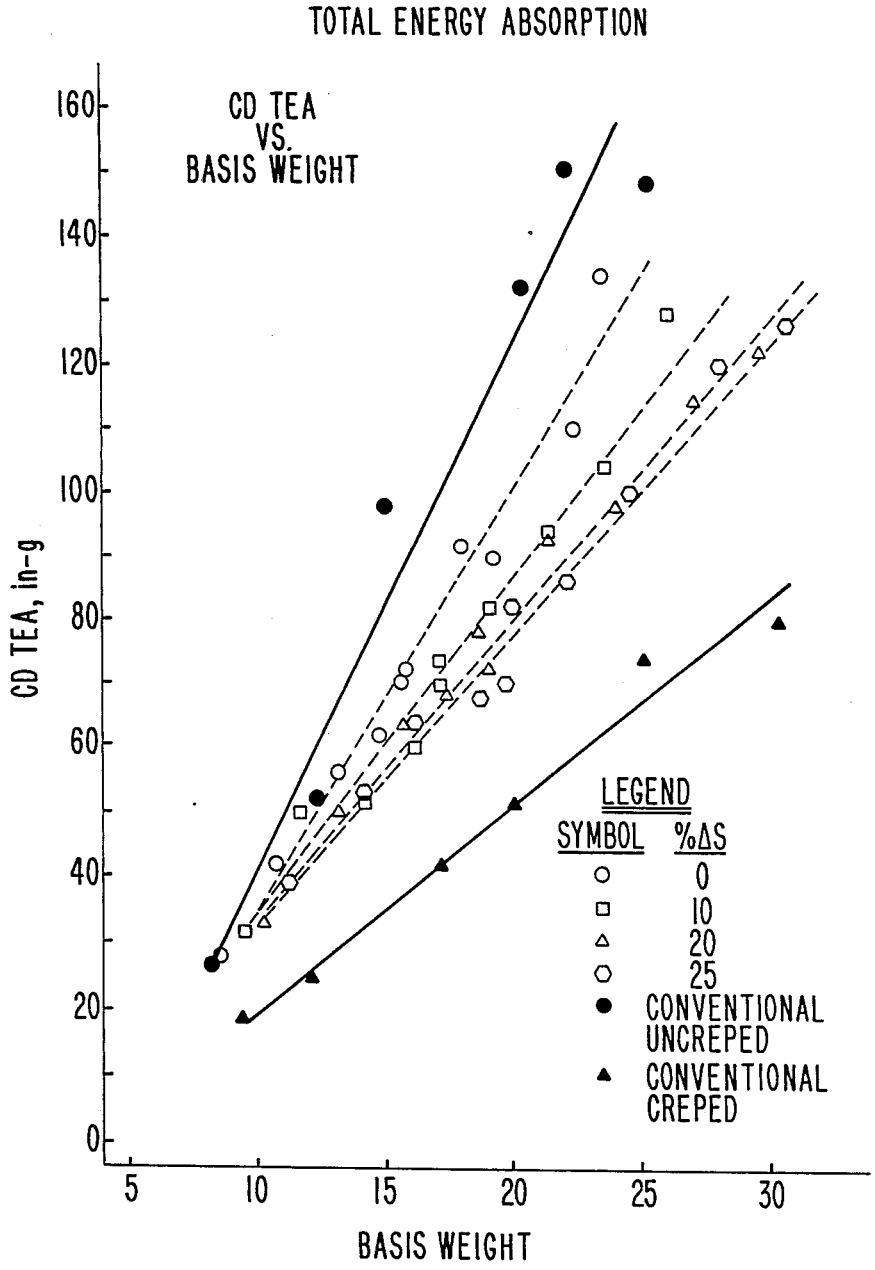

Total energy absorption is shown graphically in FIGS. 17 and 18. In both the machine direction and cross-machine direction, the TEA values, at a given basis weight, are higher for the products of the invention than for the creped product and lower than for the uncreped product.

The above test results clearly demonstrate the advantages of the invention. Compared to known products at comparable basis weights, the invention has high bulk and tensile strength and higher permeability and absorption capacity for comparable tensile strength. While test results are currently available only to 30 lb/ream basis weight, it is believed that the unique combination of characteristics for the product of the invention will apply to basis weights to about 50 lb/ream. Certainly, as seen in FIG. 7, the tensile strength advantages should continue to 50 lb/ream basis weight and beyond. While at basis weights above about 30 lb/ream, the apparent bulk (FIG. 6) of conventionally creped products appears to approach that of the invention, it is believed the bulk of the product of the invention above about 30 lb/ream basis weight will provide an advantage over conventionally creped products, particularly at comparable tensile strength (FIG. 8). Similarly, the oil holding capacity relationship between the invention and conventional products appears to remain relatively constant above about 30 lb/ream (FIG. 11), but it is believed the invention provides an advantage at higher basis weights, particularly at comparable tensile strengths.

The dashed line placed on FIGS. 7, 8 and 12 generally represent lines of demarcation setting off the instant invention from conventional products. The product of the invention generally conforms to the relationships represented by those lines. Thus, the bulky, fibrous web product of the invention comprises randomly arranged, contacting fibers bonded together in patterned undulations substantially throughout the web, the web having a basis weight (BW) in the range of about 5 to about 50 pounds per ream and having a geometric mean tensile strength (TS) in kilo grams per three inches of width, an apparent bulk (AB) in caliper points per round ream, and an oil holding capacity (OH) in milliliter per gram of fiber substantially satisfying, in absolute values, the relationships $(0.27\ BW-1)<TS>(0.17\ BW-1)$, $AB>[0.7-(TS\div 20)]$, and $OH>0.063TS^2-1.13TS+8.6$.

The invention also provides bulky, fibrous web products having substantially the same tensile strength, oil holding capacity and air permeability over a range of basis weights. These relationships are apparent from the data in Table I and FIGS. 10 and 12. Compare, for example, run numbers 2141–22 and 2141–27 which have substantially identical GM tensile strengths and oil holding capacity and over 3 lb/ream difference in basis weight. Another example is presented by run numbers 2142–38 and 2142–48 wherein products differing in basis weight by over 9 lb/ream are within 200 g/3" GM tensile strength, 0.1 ml/g oil holding capacity, and 2 fpm air permeability. Products with tensile strength (GM) of about 3000 gm/3", oil holding capacity of about 6.5 ml/gm fiber and air permeability of about 45 fpm may be made over a basis weight range of about 14 to about 20 pounds per ream. Similarly, over a range of about 20 to about 30 pounds per ream, product having a tensile strength of about 4700 gm/3", a air permeability of about 20 fpm and oil holding capacity of about 5.5 ml/gm fiber may be contained. These unique product characteristics are obtained by varying the speed differential and vacuum levels in the manufacturing process.

Finally, in accordance with the invention the embossed fibrous web product comprises randomly bonded fibers having a basis weight in the range of about 5 to about 30 pounds per ream, a geometric mean tensile strength in the range of about 1,000 to about 7,000 grams per three inches of width, apparent bulk in the range of about 0.4 to about 1.0 caliper points per pound ream, machine directions stretch in the range of about 10% to about 30% and oil holding capacity in the range of about 4.3 to about 11.0 grams per gram of fiber.

It will be apparent to those skilled in the art the various modifications and variations may be made to the product, the apparatus and the method of the invention without departing from the scope or the spirit of the invention.

What is claimed is:

1. A method of manufacturing a bulky, embossed fibrous sheet material comprising the steps of:

(a) forming a wet fibrous web;

(b) pressing said web to partially dewater it to between about 30% to about 50% solids;

(c) conveying said web to a transfer position proximate the three-dimensional, patterned surface of moving fluid-pervious embossing fabric, said web moving at said transfer position in the same direction as and at a speed greater than the fabric;

(d) transferring said web at said transfer position to said fabric without substantial mechanical compression of said web; and (e) generally conforming said web to the patterned surface of said fabric essentially solely by applying a vaccum at said transfer position through said fabric to said web; and (f) drying said web.

2. A method of manufacturing a bulky, embossed fibrous sheet material comprising the steps of:

(a) forming a wet fibrous web;

(b) pressing said web to partially dewater it to between about 30% to about 50% solids;

(c) moving a fluid-pervious material having an undulating, patterned surface at a predetermined speed;

(d) moving said web to a position proximate the surface of said material at a speed greater than said predetermined speed, said web in said position being barely in contact with the surface of said material;

(e) conforming said web to the patterned surface of said material essentially solely by applying a vacuum through said material to said web at said position; and (f) drying said web.

3. A method of manufacturing a bulky, embossed paper web comprising the steps of:

(a) forming a wet fibrous web;

(b) pressing said web to partially dewater it to between about 30% and about 50% solids;

(c) transferring said web to a rotating smooth-surfaced roll;

(d) forming a non-compression nip between said roll and a loop of fluid-pervious material having an undulating, patterned surface;

(e) rotating said material loop at a speed less than the surface speed of said roll;

(f) directly transferring said web to the patterned surface of said material without substantial mechanical compressions to said web;

(g) generally comforming said web to the patterned surface of said material essentially solely by applying a vacuum through said material approximate said nip; and (h) drying said web.

4. The method of claim 3 also including the step of transferring said wet web to a felt after the forming step and wherein said web is pressed between said felt and said roll during said pressing step.

5. The method of claim 3 wherein said material is an open-mesh imprinting fabric.

6. The method of claim 3 wherein the surface speed of said roll is about 10% to about 40% greater than the speed of said material.

7. The method of claim 3 wherein the step of applying a vacuum includes disposing within said material loop adjacent said nip a vacuum tube having an opening oriented towards said nip.

8. The method of claims 1, 2 or 3 wherein the vacuum applied is in the range of about 1 to about 20 inches of mercury.

9. An apparatus for forming a bulky, embossed paper web comprising:

(a) means for forming a wet fibrous web;

(b) compression means for partially dewatering said web to between about 30% and about 50% solids;

(c) fluid-pervious support means having a three-dimensional surface and moving at a predetermined speed for receiving and imparting a three-dimensional pattern to said web;

(d) means for conveying said web from said compression means to said support means at a speed greater than the speed of said support means, said conveying means being spaced from said support means at the point of closest relation at a distance which generally precludes mechanical compression of the web on said conveying means;

(e) embossing means for directly transferring said web from said conveying means to said support means at said point at closest relation and for pulling said web into general conformance with the three-dimensional surface of said support means, said embossing means being the sole means for transferring said web between said conveying means and support means; and (f) means for drying said web after embossing.

10. The apparatus of claim 9 wherein said compression means comprises felt-loop means for receiving said wet web from said forming means and a generally smooth-surfaced roll defining a compression nip with said felt loop means.

11. The apparatus of claim 10 wherein said support means is a continuous loop of fluid-pervious material having an undulating, patterned surface.

12. The apparatus of claim 11 wherein said material is an open-mesh imprinting fabric.

13. The apparatus of claim 11, wherein said embossing means comprises vacuum means disposed proximate said point of closest relation for directing a vacuum through said material to said web on said conveying means.

14. The apparatus of claim 9 wherein the speed of said conveying means is about 10% to about 40% greater than the speed of said support means.

* * * * *